US011236954B2

(12) United States Patent
Takafuji

(10) Patent No.: US 11,236,954 B2
(45) Date of Patent: Feb. 1, 2022

(54) HEAT EXCHANGER AND AIR-CONDITIONER

(71) Applicant: HITACHI-JOHNSON CONTROLS AIR CONDITIONING, INC., Tokyo (JP)

(72) Inventor: Ryoichi Takafuji, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 0 days.

(21) Appl. No.: 16/513,766

(22) Filed: Jul. 17, 2019

(65) Prior Publication Data

US 2019/0339027 A1 Nov. 7, 2019

Related U.S. Application Data

(63) Continuation of application No. PCT/JP2017/036040, filed on Oct. 3, 2017.

(30) Foreign Application Priority Data

Jan. 25, 2017 (JP) ..... JP2017-011620

(51) Int. Cl.
*F28F 9/02* (2006.01)
*F25B 39/00* (2006.01)
(Continued)

(52) U.S. Cl.
CPC ..... *F28F 9/0207* (2013.01); *F25B 13/00* (2013.01); *F25B 39/00* (2013.01);
(Continued)

(58) Field of Classification Search
CPC ..... F25B 13/00; F25B 39/00; F25B 39/028; F28D 1/0417; F28D 1/0426;
(Continued)

(56) References Cited

U.S. PATENT DOCUMENTS 1,802,930 A * 4/1931 Seelert ..... F28D 1/05383 165/129
2,044,455 A * 6/1936 Witzel ..... F25B 39/02 62/525
(Continued)

FOREIGN PATENT DOCUMENTS

JP 04-344033 A 11/1992
JP 11-201686 A 7/1999
(Continued)

OTHER PUBLICATIONS

International Search Report of PCT/JP2017/036040 dated Dec. 26, 2017.

*Primary Examiner* — Ljiljana V. Ciric
(74) *Attorney, Agent, or Firm* — Mattingly & Malur, PC

(57) ABSTRACT

A heat exchanger including multiple fins, multiple heat transfer pipes having an oval shape or a flat shape and joined to the fins, and a header connected, on one end side, to an end portion of an inlet pipe through which working fluid flows in upon evaporation operation and connected, on the other end side, to an end portion of each of the heat transfer pipes, wherein the header includes a longitudinal partition plate arranged to extend in a longitudinal direction and configured to divide an internal space of the header into an inlet-pipe-side space connected to the end portion of the inlet pipe and a heat-transfer-pipe-side space connected to the end portion of each of the heat transfer pipes, and an opening is formed at a position not overlapping with the inlet pipe at the longitudinal partition plate.

12 Claims, 13 Drawing Sheets

(51) Int. Cl.
*F25B 13/00* (2006.01)
*F28F 1/32* (2006.01)
*F28D 1/053* (2006.01)
*F25B 39/02* (2006.01)

(52) U.S. Cl.
CPC ..... *F28D 1/05333* (2013.01); *F28F 1/32* (2013.01); *F28F 9/028* (2013.01); *F25B 39/028* (2013.01)

(58) Field of Classification Search
CPC ..... F28D 1/05333; F28D 1/05341; F28F 9/0207; F28F 9/028; F28F 9/26; F28F 1/32; F28F 9/0278
USPC ..... 165/174
See application file for complete search history.

(56) References Cited

U.S. PATENT DOCUMENTS 2,602,647 A * 7/1952 Miller ..... B01J 8/44 165/109.1
4,023,618 A * 5/1977 Kun ..... F28F 9/0224 165/175
4,187,090 A * 2/1980 Bizzarro ..... B01D 45/08 165/111
4,223,722 A * 9/1980 Shade, Jr. ..... F22B 37/266 122/483
4,791,982 A * 12/1988 Meyerhofer ..... F28D 1/0408 165/148
4,857,144 A * 8/1989 Casparian ..... B01D 1/065 159/13.2
5,123,482 A * 6/1992 Abraham ..... F28D 1/0535 165/173
5,186,248 A * 2/1993 Halstead ..... B60H 1/3227 165/153
5,186,249 A * 2/1993 Bhatti ..... F28F 9/0212 165/174
5,261,485 A * 11/1993 Thornton ..... C02F 1/22 165/115
5,323,851 A * 6/1994 Abraham ..... B21C 23/10 165/174
5,329,995 A * 7/1994 Dey ..... F28F 9/0212 165/153
5,415,223 A * 5/1995 Reavis ..... F28F 9/0278 165/159
5,934,367 A * 8/1999 Shimmura ..... F28F 9/0278 165/174
6,035,931 A * 3/2000 Kado ..... F28F 9/0212 165/153
6,293,334 B1 * 9/2001 Ghiani ..... F28D 1/05375 165/149
6,382,313 B2 * 5/2002 Mitsumoto ..... B01J 19/002 165/158
6,494,253 B2 * 12/2002 Gotou ..... F28F 9/0278 165/115
6,510,894 B1 * 1/2003 Watton ..... B01J 19/0013 165/166
6,543,528 B2 * 4/2003 Saito ..... F28D 1/0341 165/152
6,705,392 B2 * 3/2004 Gotou ..... H01M 8/0612 165/140
6,817,407 B2 * 11/2004 Wagner ..... F25J 3/04412 165/145
6,892,805 B1 * 5/2005 Valensa ..... F28F 9/0278 165/173
7,025,128 B2 * 4/2006 Kamiyama ..... F28D 1/0443 165/140
7,036,571 B2 * 5/2006 Kamiyama ..... F28D 1/0443 165/140
7,051,796 B2 * 5/2006 Kamiyama ..... F28D 1/0443 165/140
7,066,243 B2 * 6/2006 Horiuchi ..... F25B 39/02 165/174
7,275,394 B2 * 10/2007 Lundberg ..... F28D 1/05391 165/DIG. 483
7,484,555 B2 * 2/2009 Beamer ..... F28F 9/0265 165/174
7,571,761 B2 * 8/2009 Katoh ..... F28D 1/05391 165/174
7,708,054 B2 * 5/2010 Watanabe ..... F28F 9/0204 165/176
7,819,177 B2 * 10/2010 Beamer ..... F28F 9/0246 165/174
7,832,231 B2 * 11/2010 Knight ..... F28D 1/05391 62/509
7,886,812 B2 * 2/2011 Higashiyama ..... F28F 9/0202 165/174
7,896,066 B2 * 3/2011 Higashiyama ..... F28D 1/05391 165/174
8,146,652 B2 * 4/2012 Higashiyama ..... F28D 1/05391 165/176
8,176,750 B2 * 5/2012 Higashiyama ..... F28D 1/05391 62/515
8,210,246 B2 * 7/2012 Bhatti ..... F28D 1/0426 165/140
8,235,099 B2 * 8/2012 Higashiyama ..... F28F 9/0217 165/174
8,281,615 B2 * 10/2012 Tucker ..... F28F 1/025 62/515
8,353,330 B2 * 1/2013 Lim ..... F28F 9/0204 165/76
8,371,366 B2 * 2/2013 Higashiyama ..... F28D 1/05391 165/176
8,464,782 B2 * 6/2013 Samuelson ..... F28F 9/262 165/178
8,485,248 B2 * 7/2013 Coyle ..... F28F 1/022 165/174
8,590,607 B2 * 11/2013 Demuth ..... F28D 1/05391 165/176
8,708,037 B2 * 4/2014 Tokizaki ..... F28F 9/0243 165/175
8,935,854 B2 * 1/2015 Hirayama ..... F28F 9/0278 29/890.03
9,033,029 B2 * 5/2015 Park ..... F28F 9/028 165/151
9,115,934 B2 * 8/2015 Kopchick ..... F28F 9/028
9,267,737 B2 * 2/2016 Matter, III ..... F28D 1/05383
9,328,966 B2 * 5/2016 Brauning ..... F28F 9/02
9,625,219 B2 * 4/2017 Takagi ..... F28F 9/028
9,631,871 B2 * 4/2017 Contet ..... F28F 9/0224
9,803,928 B2 * 10/2017 Takagi ..... F28D 1/05391
2004/0206490 A1 * 10/2004 Katoh ..... F25B 39/02 165/174
2005/0006080 A1 * 1/2005 Kamiyama ..... F28D 1/0443 165/174
2005/0006081 A1 * 1/2005 Kamiyama ..... F28F 13/00 165/174
2005/0103486 A1 * 5/2005 Demuth ..... F28D 1/05391 165/174
2005/0126770 A1 * 6/2005 Higashiyama ..... F28D 1/0333 165/174
2006/0137870 A1 * 6/2006 Ohhashi ..... F28F 9/0212 165/174
2006/0266502 A1 * 11/2006 Khazani ..... F28F 9/0209 165/146
2007/0062679 A1 * 3/2007 Agee ..... F28F 9/0263 165/158
2007/0158057 A1 * 7/2007 Higashiyama ..... F25B 39/022 165/174
2007/0187080 A1 * 8/2007 Sonoda ..... F28F 9/0246 165/174
2008/0023185 A1 * 1/2008 Beamer ..... F28F 9/0207 165/174
2008/0141706 A1 * 6/2008 Tucker ..... F25B 39/028 62/498
2009/0095458 A1 * 4/2009 Lim ..... F28F 9/0224 165/174
2009/0114379 A1 * 5/2009 Lim ..... F28F 9/0204 165/151

(56) References Cited

U.S. PATENT DOCUMENTS

2009/0229805 A1* 9/2009 Beamer ..... F28F 9/0243 165/174
2011/0088885 A1* 4/2011 Samuelson ..... F28F 1/126 165/176
2011/0139413 A1* 6/2011 Coyle ..... F28F 9/0278 165/148
2011/0139421 A1* 6/2011 Coyle ..... F28D 1/05391 165/173
2011/0174472 A1* 7/2011 Kurochkin ..... F28F 9/0214 165/174
2013/0081795 A1* 4/2013 Janezich ..... F28F 9/0221 165/173
2014/0096944 A1* 4/2014 Seo ..... F28F 9/0273 165/174
2014/0224461 A1* 8/2014 Bellenfant ..... F28F 9/0214 165/174
2014/0311702 A1* 10/2014 Takagi ..... F25B 39/028 165/41
2014/0338874 A1* 11/2014 Jindou ..... F28F 9/027 165/173
2015/0101363 A1* 4/2015 Matsuda ..... F28F 9/027 62/525
2015/0114030 A1* 4/2015 Park ..... F28D 1/05325 62/507
2015/0226498 A1* 8/2015 Park ..... F28D 1/05391 165/174
2015/0241131 A1* 8/2015 Katoh ..... F28D 1/05391 165/140
2016/0109168 A1* 4/2016 Baba ..... F28F 9/0265 62/515
2016/0169596 A1* 6/2016 Jindou ..... F25B 39/00 62/526
2016/0223231 A1* 8/2016 Morimoto ..... F28F 9/0265
2017/0051988 A1* 2/2017 Dziubinschi ..... F28F 1/06
2017/0096043 A1* 4/2017 Lim ..... B60H 1/004
2018/0156512 A1* 6/2018 Mislak ..... F25B 39/028

FOREIGN PATENT DOCUMENTS

JP 2009-041876 A 2/2009
JP 2013-130386 A 7/2013
JP 2014-037899 A 2/2014
JP 2015-045421 A 3/2015
JP 2015-068622 A 4/2015

* cited by examiner

HEAT EXCHANGER AND AIR-CONDITIONER

CROSS-REFERENCE TO RELATED APPLICATION

The present application is a continuation application of International Application No. PCT/JP2017/036040, filed Oct. 3, 2017, which claims priority to Japanese Patent Application No. 2017-011620, filed Jan. 25, 2017. The contents of these applications are incorporated herein by reference in their entirety.

BACKGROUND

1. Technical Field

The present disclosure relates to a heat exchanger and an air-conditioner.

2. Related Art

Typically, a heat exchanger called an indoor heat exchanger or an outdoor heat exchanger is mounted on an indoor unit or an outdoor unit of an air-conditioner. A heat exchanger including multiple heat transfer pipes, multiple fins joined to the heat transfer pipes, and one or more headers (a header pipe assembly) coupled to one or both of one end side and the other end side of the multiple heat transfer pipes has been known as the heat exchanger (see, e.g., JP-A-2015-68622).

The heat exchanger of this type distributes and supplies working fluid (refrigerant), which has flowed into the header from external equipment, from the header to each heat transfer pipe, and conversely, supplies working fluid (refrigerant), which has flowed into the header from each heat transfer pipe, from the header to the external equipment. In this process, the heat exchanger exchanges heat between the working fluid (refrigerant) flowing in the heat transfer pipes and air flowing outside the heat transfer pipes.

SUMMARY

A heat exchanger according to an embodiment of the present disclosure includes multiple fins, multiple heat transfer pipes having an oval shape or a flat shape and joined to the fins, and a header connected, on one end side, to an end portion of an inlet pipe through which working fluid flows in upon evaporation operation and connected, on the other end side, to an end portion of each of the heat transfer pipes, wherein the header includes a longitudinal partition plate arranged to extend in a longitudinal direction and configured to divide an internal space of the header into an inlet-pipe-side space connected to the end portion of the inlet pipe and a heat-transfer-pipe-side space connected to the end portion of each of the heat transfer pipes, and an opening is formed at a position not overlapping with the inlet pipe at the longitudinal partition plate.

DETAILED DESCRIPTION

Figure 1:
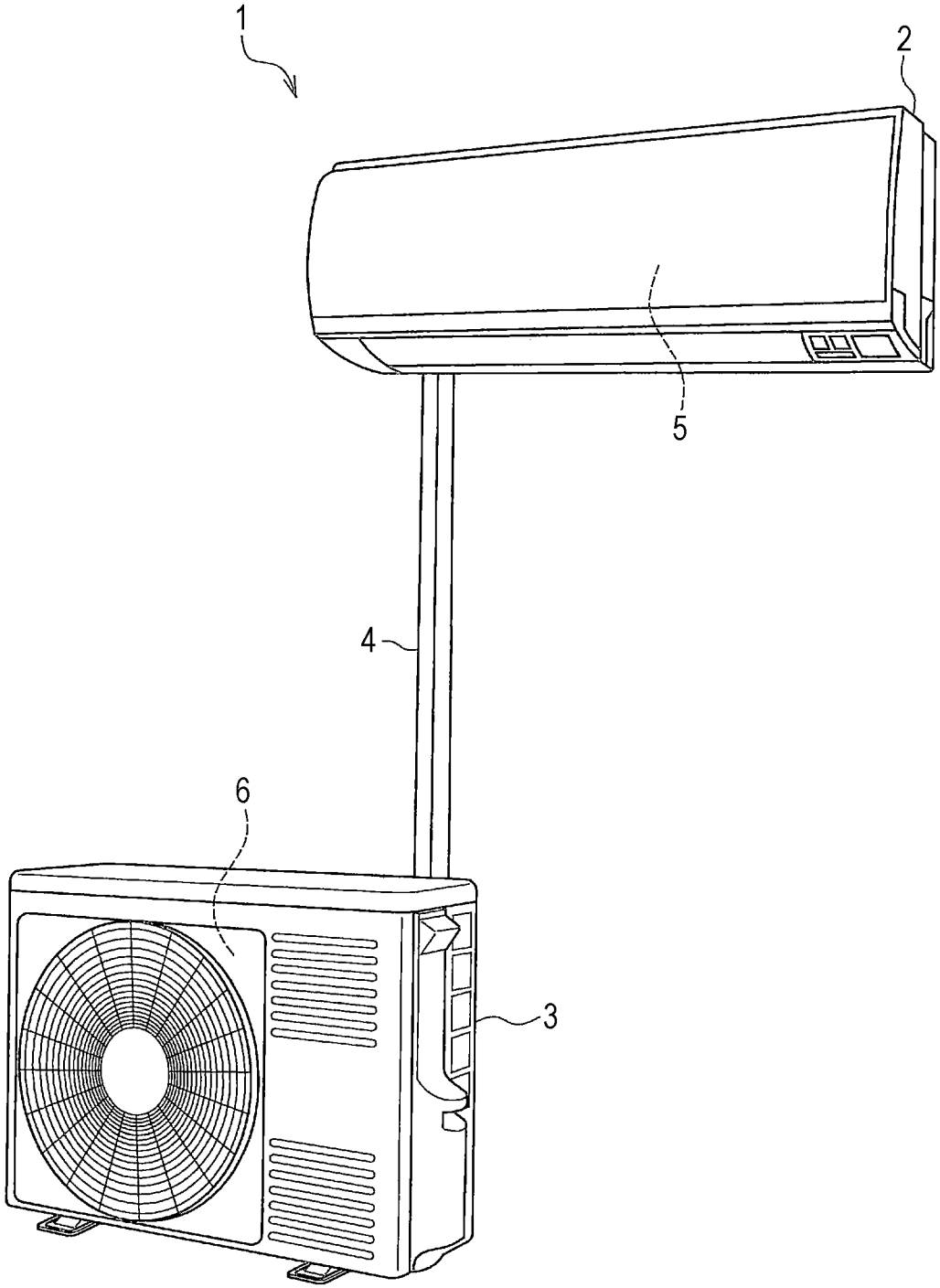
FIG. 1 is a view of an entire configuration of an air-conditioner according to a first embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, for the typical heat exchanger described in JP-A-2015-68622, it has been demanded to improve the performance for distributing the working fluid (refrigerant) from the header to each heat transfer pipe as described below.

For example, the typical heat exchanger described in JP-A-2015-68622 is configured such that a pipe functioning as an inlet pipe for gas-liquid two-phase working fluid (refrigerant) in evaporation operation is arranged on a lower side of the header. The typical heat exchanger distributes, in the evaporation operation, the working fluid (refrigerant) to each heat transfer pipe connected to the header while the working fluid (refrigerant) having flowed into the lower side of the header through the inlet pipe is flowing on an upper side of the header. At this point, drift of the working fluid (refrigerant) might be caused inside the header.

The drift of the working fluid (refrigerant) is, for example, caused by an imbalanced liquid flow due to influence of a speed difference between liquid and gas contained in the gas-liquid two-phase working fluid (refrigerant). The drift of the working fluid (refrigerant) is less caused in a case where the liquid and the gas are mixed together, but is easily caused in a case where the liquid and the gas are separated from each other.

In the typical heat exchanger, the drift of the working fluid (refrigerant) is easily caused on the lower side of the header connected to the inlet pipe. Moreover, in the typical heat exchanger, when the drift of the working fluid (refrigerant)

is caused inside the header, distribution of the working fluid (refrigerant) from the header to each heat transfer pipe becomes nonuniform. As a result, a specific heat transfer pipe (e.g., the heat transfer pipe connected to the upper side of the header) is overheated, and for this reason, heat exchange performance is degraded. Thus, for the typical heat exchanger, it has been demanded to improve the performance for distributing the working fluid (refrigerant) from the header to each heat transfer pipe so that distribution of the working fluid (refrigerant) from the header to each heat transfer pipe can be brought close to a uniform state.

A heat exchanger according to an embodiment of the present disclosure has been made for solving the above-described problems. A main object of the present disclosure is to provide a heat exchanger configured so that the performance for distributing working fluid (refrigerant) from a header to each heat transfer pipe can be improved and an air-conditioner including the heat exchanger.

For accomplishing the above-described object, the present disclosure relates to a heat exchanger including multiple fins, multiple heat transfer pipes having an oval shape or a flat shape and joined to the fins, and a header connected, on one end side, to an end portion of an inlet pipe through which working fluid flows in upon evaporation operation and connected, on the other end side, to an end portion of each heat transfer pipe, the header including a longitudinal partition plate arranged to extend in a longitudinal direction and configured to divide an internal space of the header into an inlet-pipe-side space connected to the end portion of the inlet pipe and a heat-transfer-pipe-side space connected to the end portion of each heat transfer pipe and an opening being formed at a position not overlapping with the inlet pipe at the longitudinal partition plate; and relates to an air-conditioner including the heat exchanger. Other methods will be described later.

According to the present invention, the performance for distributing the working fluid (refrigerant) from the header to each heat transfer pipe can be improved.

Hereinafter, an embodiment of the present disclosure (hereinafter referred to as a "present embodiment") will be described in detail with reference to the drawings. Note that each figure is merely schematically illustrated to such an extent that the present embodiment can be sufficiently understood. Thus, the present embodiment is not limited only to illustrated examples. Moreover, in each figure, the same reference numerals are used to represent common components or similar components, and overlapping description thereof will be omitted.

First Embodiment

In the present embodiment, the flow of gas-liquid two-phase working fluid (refrigerant) having flowed into a header is rapidly deflected, and in this manner, influence of a speed difference between liquid and gas contained in the gas-liquid two-phase working fluid (refrigerant) is minimized and an imbalanced liquid flow is reduced. Moreover, in the present embodiment, the liquid and the gas of the gas-liquid two-phase working fluid (refrigerant) are mixed efficiently while the working fluid (refrigerant) is gently dropping inside the header due to the force of gravity. The present embodiment has such a technical idea that occurrence of drift of the working fluid (refrigerant) inside the header is reduced by these principles.

<Configuration of Air-Conditioner>

Hereinafter, a configuration of an air-conditioner 1 according to a first embodiment will be described with reference to FIG. 1. FIG. 1 is a view of the configuration of the air-conditioner 1 according to the first embodiment.

As illustrated in FIG. 1, the air-conditioner 1 according to the present embodiment has an indoor unit 2 arranged inside a room, and an outdoor unit 3 arranged outside the room (in an outdoor space). The indoor unit 2 includes a built-in indoor heat exchanger 5 configured to exchange heat between the working fluid (refrigerant) and indoor air. The outdoor unit 3 includes a built-in outdoor heat exchanger 6 configured to exchange heat between the working fluid (refrigerant) and outdoor air.

The indoor unit 2 sucks the indoor air, and performs heat exchange between the working fluid (refrigerant) and the indoor air with the indoor heat exchanger 5 to obtain conditioned air subjected to any optional processing of heating, cooling, and dehumidification. Then, the indoor unit 2 blows the obtained conditioned air into the room. In this manner, the indoor unit 2 air-conditions the inside of the room. The indoor unit 2 is connected to the outdoor unit 3 through a connection pipe 4 such that the working fluid (refrigerant) circulates between the indoor unit 2 and the outdoor unit 3. The outdoor unit 3 performs heat exchange between the working fluid (refrigerant) and the outdoor air in the outdoor heat exchanger 6.

In heating operation of the air-conditioner 1, the indoor heat exchanger 5 functions as a condenser to perform condensation operation, and the outdoor heat exchanger 6 functions as an evaporator to perform evaporation operation. Then, the working fluid (refrigerant) is condensed into a liquid state in the indoor heat exchanger 5, and thereafter, is expanded by an expansion valve (not shown) and turns into low-temperature low-pressure gas-liquid two-phase working fluid (refrigerant). This gas-liquid two-phase working fluid (refrigerant) flows into the outdoor heat exchanger 6, and then, turns into a gaseous state in the outdoor heat exchanger 6.

On the other hand, in cooling operation, the outdoor heat exchanger 6 functions as the condenser to perform the condensation operation, and the indoor heat exchanger 5 functions as the evaporator to perform the evaporation operation. Then, the working fluid (refrigerant) is condensed into the liquid state by the outdoor heat exchanger 6, and thereafter, is expanded by the expansion valve (not shown) and turns into the low-temperature low-pressure gas-liquid two-phase working fluid (refrigerant). This gas-liquid two-phase working fluid (refrigerant) flows into the indoor heat exchanger 5, and then, turns into the gaseous state in the indoor heat exchanger 5.

<Configuration of Outdoor Heat Exchanger>

The present embodiment is applicable to both the indoor heat exchanger 5 and the outdoor heat exchanger 6. Note that the first embodiment is characterized in a configuration of a later-described header 16 of the outdoor heat exchanger 6, and therefore, a configuration of the outdoor heat exchanger 6 (specifically the configuration of the header 16) will be mainly described.

Figure 2:
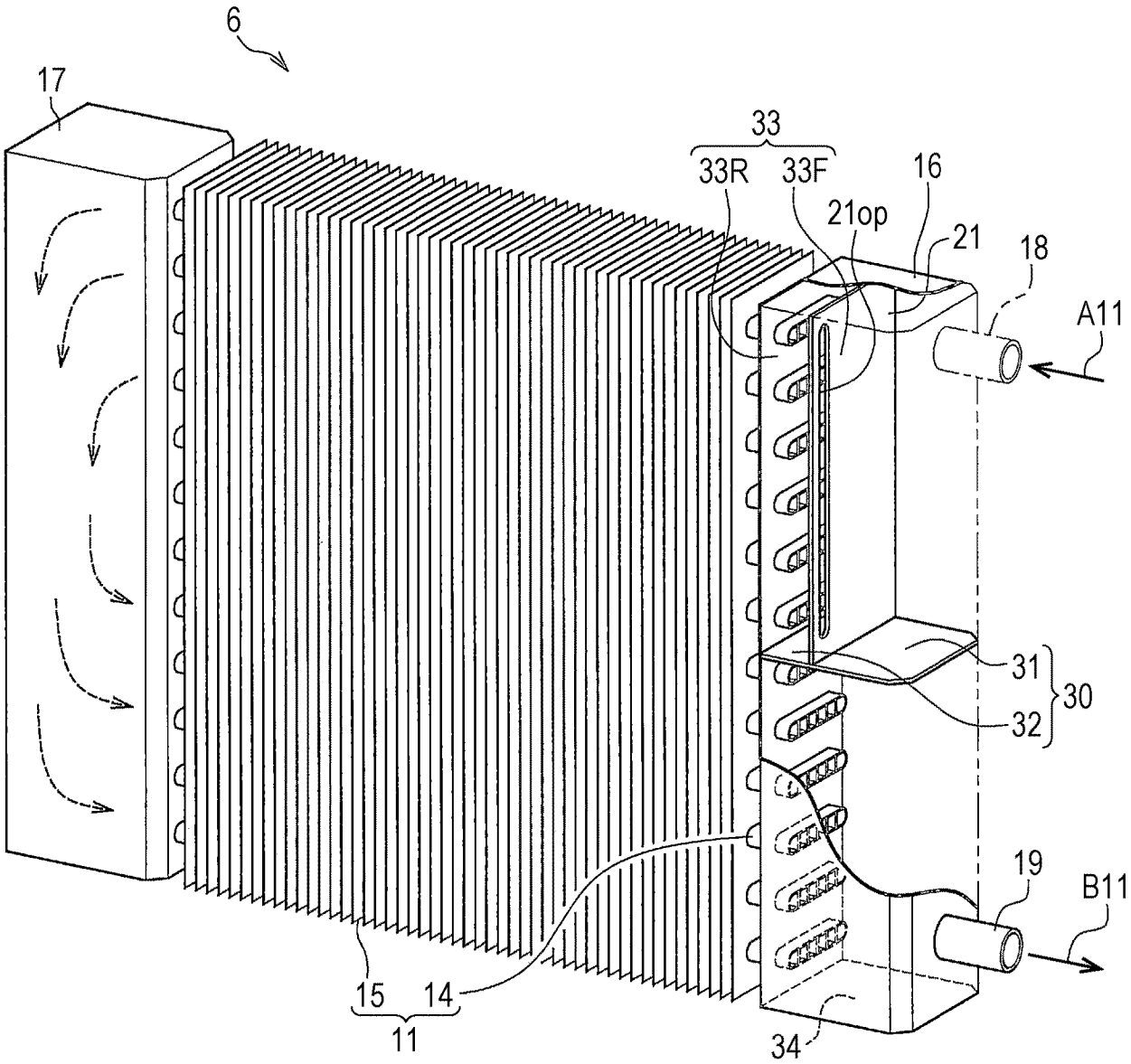
FIG. 2 is a view of a configuration of an outdoor heat exchanger according to the first embodiment.
Figure 3A:
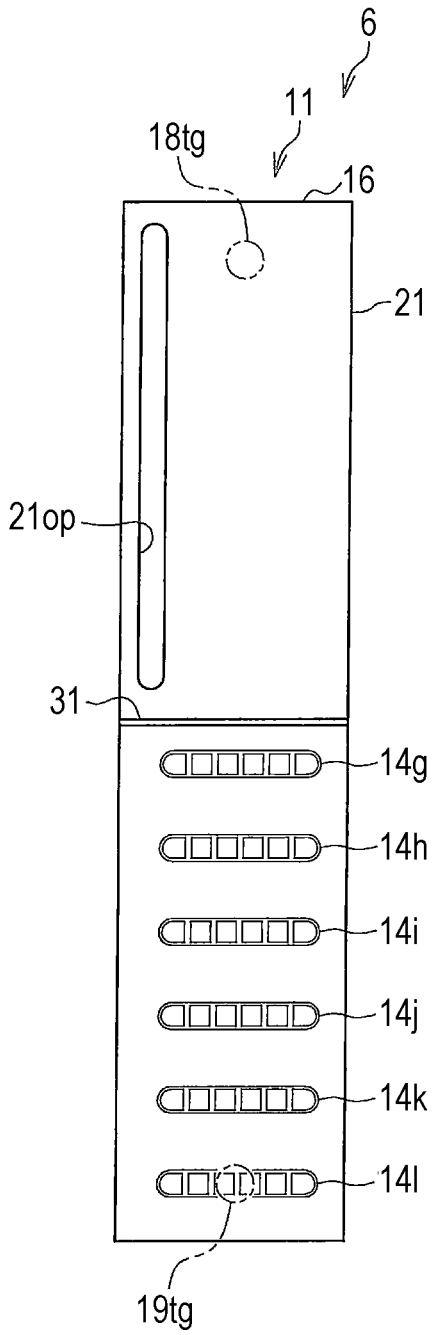
FIGS. 3A and 3B are views of an internal structure of a header of the outdoor heat exchanger according to the first embodiment.
Figure 3B:
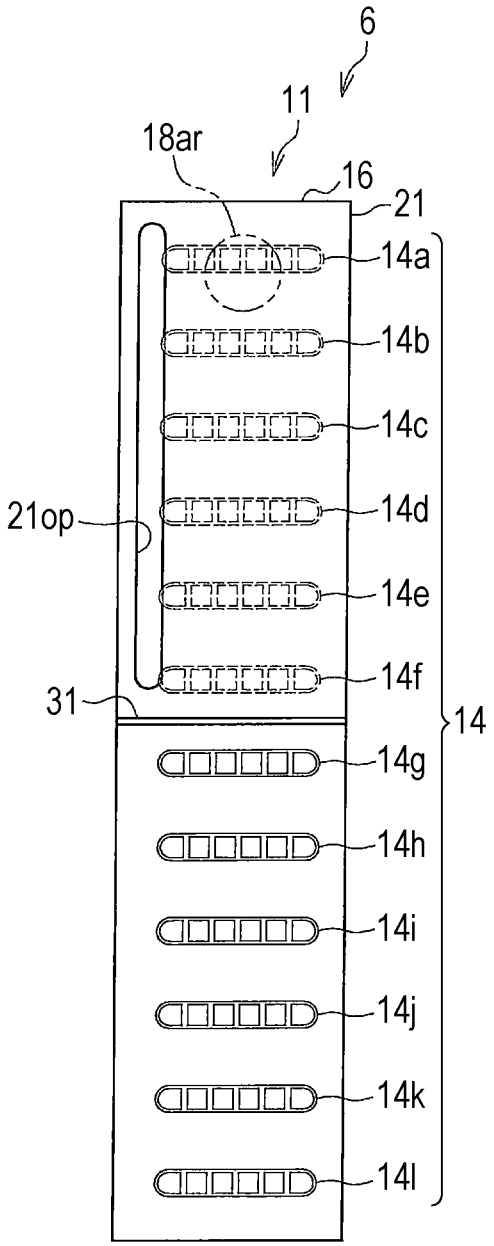

Hereinafter, the configuration of the outdoor heat exchanger 6 will be described with reference to FIGS. 2, 3A, and 3B. FIG. 2 is a view of the configuration of the outdoor heat exchanger 6. FIGS. 3A and 3B are views of an internal structure of the header 16 of the outdoor heat exchanger 6. FIG. 3A illustrates a structure in a case where the inside of the header 16 is viewed not through a longitudinal partition plate 21, and FIG. 3B illustrates a structure in a case where the inside of the header 16 is viewed through the longitudinal partition plate 21.

As illustrated in FIG. 2, the outdoor heat exchanger 6 includes a heat exchange section 11 and the headers 16, 17. The case of performing the heating operation by the air-conditioner 1 (i.e., the case of performing the condensation operation by the indoor heat exchanger 5 and performing the evaporation operation by the outdoor heat exchanger 6) is assumed and described herein. The heat exchange section 11 is a mechanism configured to perform heat exchange between the working fluid (refrigerant) and the outdoor air. The headers 16, 17 are containers configured to temporarily store the working fluid (refrigerant). In the headers 16, 17, spaces for temporarily storing the working fluid (refrigerant) are provided. The headers 16, 17 distribute and supply the working fluid (refrigerant) having flowed from the indoor unit 2 (see FIG. 1) to each heat transfer pipe 14 describer later, and conversely, supply the working fluid (refrigerant) having flowed from each heat transfer pipe 14 described later to the indoor unit 2 (see FIG. 1).

The heat exchange section 11 has the multiple heat transfer pipes 14 and multiple fins 15. The heat transfer pipe 14 is a pipe for supplying the refrigerant. The fin 15 is a plate-shaped member for expanding a heat transfer surface. Each heat transfer pipe 14 is in an oval shape or a flat shape, and is joined to penetrate each fin 15. An end portion of each heat transfer pipe 14 is inserted into the headers 16, 17. The end portion of each heat transfer pipe 14 opens in internal spaces of the headers 16, 17.

The header 16 is connected to a pipe 18 (hereinafter referred to as an "inlet pipe 18") functioning as an inlet pipe for supplying the working fluid (refrigerant) from an indoor heat exchanger 5 side to an outdoor heat exchanger 6 side in the heating operation (the evaporation operation of the outdoor heat exchanger 6) and a pipe 19 (hereinafter referred to as an "outlet pipe 19") functioning as an outlet pipe for supplying the working fluid (refrigerant) from the outdoor heat exchanger 6 side to the indoor heat exchanger 5 side in the heating operation (the evaporation operation of the outdoor heat exchanger 6). Note that the functions of the pipe 18 and the pipe 19 are inverted in the cooling operation (the condensation operation of the outdoor heat exchanger 6) (i.e., the pipe 18 serves as the outlet pipe, and the pipe 19 serves as the inlet pipe).

The inlet pipe 18 is connected to the header 16 at a relatively-high position, and on the other hand, the outlet pipe 19 is connected to the header 16 at a relatively-low position. The working fluid (refrigerant) flows in the direction of an arrow A11 through an internal flow path provided inside the inlet pipe 18. Moreover, the working fluid (refrigerant) flows in the direction of an arrow B11 through an internal flow path provided inside the outlet pipe 19. In the header 16, the longitudinal partition plate 21 and a lateral partition plate 30 are provided.

Note that the header 17 is not directly connected to the inlet pipe 18 and the outlet pipe 19, and has a structure without the longitudinal partition plate 21 and the lateral partition plate 30. The header 17 is connected to each heat transfer pipe 14, and has the structure for returning the working fluid (refrigerant) having flowed from a header 16 side to the header 16 side. In the header 17, the working fluid (refrigerant) flows along a dashed arrow.

The longitudinal partition plate 21 is a plate-shaped member configured to divide the internal space of the header 16 into an inlet-pipe-side upper space 33F connected to an end portion of the inlet pipe 18 and a heat-transfer-pipe-side upper space 33R connected to the end portion of each heat transfer pipe 14. The longitudinal partition plate 21 is in a substantially flat shape on both surfaces. The longitudinal partition plate 21 is arranged to extend in a longitudinal direction in the header 16. Note that the inlet-pipe-side upper space 33F and the heat-transfer-pipe-side upper space 33R form an upper space 33 on an upper side in the internal space of the header 16 divided into the upper and lower sides by the lateral partition plate 30. In the first embodiment, the longitudinal partition plate 21 is arranged only in the upper space 33.

At the longitudinal partition plate 21, an elongated hole-shaped (slit-shaped) opening 21*op* extending in an upper-to-lower direction is formed. The opening 21*op* functions as a flow path for the working fluid (refrigerant). The longitudinal partition plate 21 allows the working fluid (refrigerant) to flow between the inlet-pipe-side upper space 33F and the heat-transfer-pipe-side upper space 33R through the opening 21*op*.

The lateral partition plate 30 is a plate-shaped member configured to divide the internal space of the header 16 into the upper space 33 on the upper side and a lower space 34 on the lower side with a liquid-tight state and a gas-tight state being held. The lateral partition plate 30 is arranged to extend in a lateral direction in the header 16. The inlet pipe 18 is connected to the header 16 such that the inlet pipe 18 can be connected to the upper space 33. Moreover, the outlet pipe 19 is connected to the header 16 such that the outlet pipe 19 can be connected to the lower space 34.

The lateral partition plate 30 includes an inlet-pipe-side lateral partition plate 31 arranged on an inlet pipe 18 side with respect to the longitudinal partition plate 21, and a heat-transfer-pipe-side lateral partition plate 32 arranged on a heat transfer pipe 14 side with respect to the longitudinal partition plate 21. The inlet-pipe-side lateral partition plate 31 and the heat-transfer-pipe-side lateral partition plate 32 are joined to the longitudinal partition plate 21. The inlet-pipe-side lateral partition plate 31 and the heat-transfer-pipe-side lateral partition plate 32 are in a substantially flat shape on both surfaces.

In an example of FIGS. 3A and 3B, the header 16 is connected to 12 heat transfer pipes 14*a* to 14*l*, and has such a structure that the inlet-pipe-side lateral partition plate 31 is arranged between the sixth heat transfer pipe 14*f* and the seventh heat transfer pipe 14*g* from the top. Note that the heat-transfer-pipe-side lateral partition plate 32 (see FIG. 2) is arranged on a far side of the inlet-pipe-side lateral partition plate 31.

The opening 21*op* is formed to extend in the upper-to-lower direction at the side of an opposing portion 18*tg* (see FIG. 3A) facing the inlet pipe 18. The opposing portion 18*tg* (see FIG. 3A) is a portion of the longitudinal partition plate 21 facing the end portion of the inlet pipe 18. The opposing portion 18*tg* (see FIG. 3A) is a portion that the gas-liquid two-phase working fluid (refrigerant) having flowed into the header 16 through the internal flow path of the inlet pipe 18 along the direction of the arrow A11 (see FIG. 2) collides. An upper end of the opening 21*op* is arranged at a position higher than the position of the heat transfer pipe 14*a* (see FIG. 3B) arranged at the highest position.

The inlet pipe 18 is arranged within an arrangement area 18*ar* (see FIG. 3B). Thus, the opposing portion 18*tg* (see FIG. 3A) for the inlet pipe 18 is arranged within the arrangement area 18*ar* (see FIG. 3B) for the inlet pipe 18.

The arrangement area 18*ar* (see FIG. 3B) is set to include the position of the heat transfer pipe 14*a* so that the working fluid (refrigerant) can be distributed to the heat transfer pipe 14*a* (see FIG. 3B) arranged at the highest position. Moreover, the arrangement area 18*ar* (see FIG. 3B) is set considering the inner diameter of the internal flow path of the inlet pipe 18 such that an upper end portion of the internal flow path of the inlet pipe 18 is arranged higher than a lower end portion of the heat transfer pipe 14*a*. That is, the inlet pipe 18 is arranged at such a position that a shadow of the end portion of the inlet pipe 18 projected in the direction of the longitudinal partition plate 21 along an extension direction of the inlet pipe 18 is on the heat transfer pipe 14*a* arranged at the highest position. The arrangement area 18*ar* (see FIG. 3B) is set such that the inlet pipe 18 is arranged at such a position.

<Flow of Working Fluid (Refrigerant) Inside Header>

Figure 4:
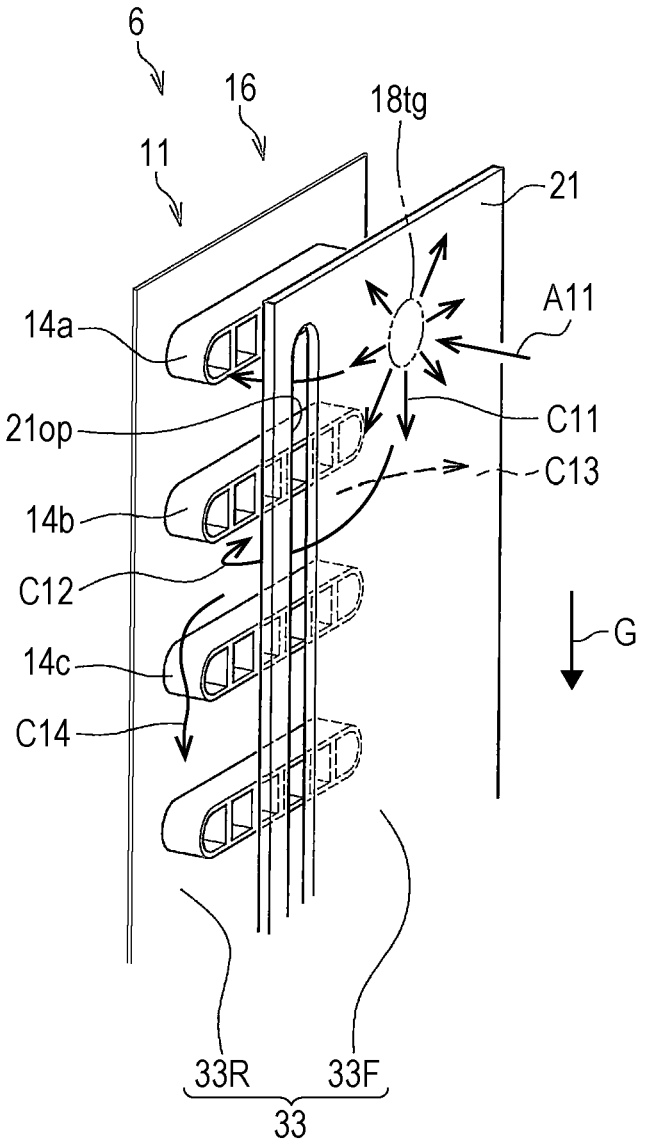
FIG. 4 is a view of the flow of working fluid (refrigerant) inside the header of the first embodiment (No. 1)
Figure 5A:
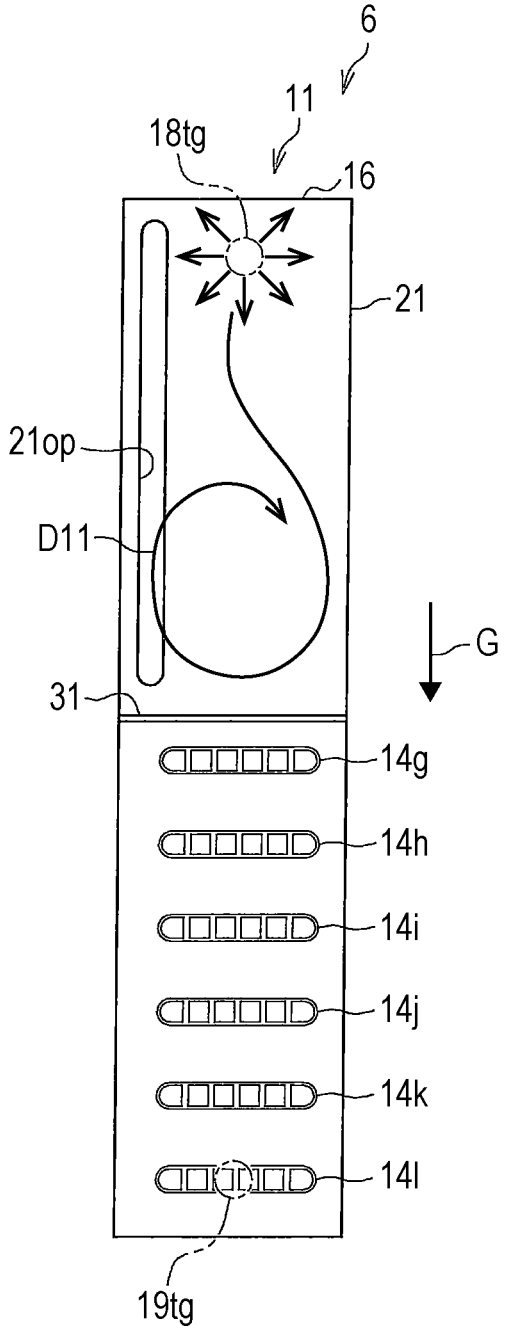
FIGS. 5A and 5B are views of the flow of working fluid (refrigerant) inside the header of the first embodiment (No. 2)
Figure 5B:
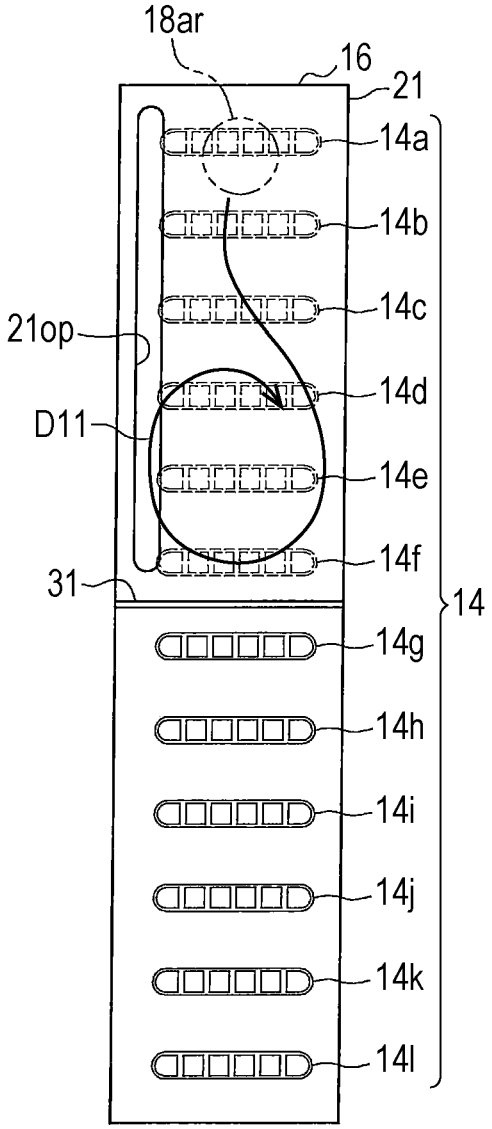

Hereinafter, the flow of the working fluid (refrigerant) inside the header 16 will be described with reference to FIGS. 4, 5A, and 5B. FIGS. 4, 5A, and 5B are views of the flow of the working fluid (refrigerant) inside the header 16. FIG. 4 illustrates the flow of the working fluid (refrigerant) in the vicinity of the opposing portion 18*tg* for the inlet pipe 18. FIG. 5A illustrates the flow of the working fluid (refrigerant) in a case where the inside of the header 16 is viewed not through the longitudinal partition plate 21, and FIG. 5B illustrates the flow of the working fluid (refrigerant) in a case where the inside of the header 16 is viewed through the longitudinal partition plate 21.

As illustrated in FIG. 4, the gas-liquid two-phase working fluid (refrigerant) flows into the header 16 through the internal flow path of the inlet pipe 18 (see FIG. 2) along the direction of the arrow A11. Then, the gas-liquid two-phase working fluid (refrigerant) comes into contact with the longitudinal partition plate 21 at the opposing portion 18*tg* for the inlet pipe 18.

When colliding with the longitudinal partition plate 21, the gas-liquid two-phase working fluid (refrigerant) flows on a surface of the longitudinal partition plate 21 to expand from the opposing portion 18*tg* toward the periphery thereof. For example, part of the gas-liquid two-phase working fluid (refrigerant) flows diagonally upward or flows laterally. Moreover, part of the gas-liquid two-phase working fluid (refrigerant) flows diagonally downward or flows downward. When reaching the opening 21*op*, the gas-liquid two-phase working fluid (refrigerant) flows from the inlet-pipe-side upper space 33F into the heat-transfer-pipe-side upper space 33R through the opening 21*op*.

In this state, part of the gas-liquid two-phase working fluid (refrigerant) directly flows into the flow path of each heat transfer pipe 14 through the end portion of each heat transfer pipe 14 (see, e.g., the first heat transfer pipe 14*a* from the top). Moreover, the remaining part of the gas-liquid two-phase working fluid (refrigerant) gently flows, for example, around the heat transfer pipes 14 while dropping due to the force of gravity (see an arrow G), and flows into the flow path of each heat transfer pipe 14 through the end portion of each heat transfer pipe 14 (see, e.g., the second heat transfer pipe 14*b* and the third heat transfer pipe 14*c* from the top). As described above, the header 16 distributes the gas-liquid two-phase working fluid (refrigerant) to each heat transfer pipe 14.

For example, in the illustrated example, the gas-liquid two-phase working fluid (refrigerant) collides with the longitudinal partition plate 21 at the opposing portion 18*tg* for the inlet pipe 18 to expand to around the opposing portion 18*tg*. Part of such fluid flows diagonally downward on the surface of the longitudinal partition plate 21 along an arrow C11, and further flows from the inlet-pipe-side upper space 33F into the heat-transfer-pipe-side upper space 33R through the opening 21*op* along an arrow C12. The gas-liquid two-phase working fluid (refrigerant) having flowed into the heat-transfer-pipe-side upper space 33R is branched into the direction of an arrow C13 and the direction of an arrow C14. The gas-liquid two-phase working fluid (refrigerant) having flowed in the direction of the arrow C13 gradually drops while flowing between the end portions of the heat transfer pipes 14, and flows into the flow path of each heat transfer pipe 14 through the end portion of each heat transfer pipe 14. Meanwhile, the gas-liquid two-phase working fluid (refrigerant) having flowed in the direction of the arrow C14 gradually drops along outer wall surfaces of the heat transfer pipes 14.

As illustrated in FIGS. 5A and 5B, part of the gas-liquid two-phase working fluid (refrigerant) does not flow into the flow path of each heat transfer pipe 14, but drops onto the inlet-pipe-side lateral partition plate 31 and the heat-transfer-pipe-side lateral partition plate 32 (see FIG. 2). That is, part of the gas-liquid two-phase working fluid (refrigerant) is not distributed to each heat transfer pipe 14, but drops onto the inlet-pipe-side lateral partition plate 31 and the heat-transfer-pipe-side lateral partition plate 32 (see FIG. 2). Then, the inlet-pipe-side lateral partition plate 31 on an inlet-pipe-side upper space 33F (see FIG. 2) side and the heat-transfer-pipe-side lateral partition plate 32 (see FIG. 2) on a heat-transfer-pipe-side upper space 33R (see FIG. 2) side hold the working fluid (refrigerant) thereon. As a result, the working fluid (refrigerant) is accumulated on the inlet-pipe-side lateral partition plate 31 and the heat-transfer-pipe-side lateral partition plate 32 (see FIG. 2). The working fluid (refrigerant) accumulated on the inlet-pipe-side lateral partition plate 31 flows from the inlet-pipe-side upper space 33F (see FIG. 2) side to the heat-transfer-pipe-side upper space 33R (see FIG. 2) side through the opening 21*op*. Moreover, the working fluid (refrigerant) accumulated on the heat-transfer-pipe-side lateral partition plate 32 (see FIG. 2) flows into the flow path of each heat transfer pipe 14 through the end portions of the heat transfer pipes 14 therearound (e.g., the heat transfer pipes 14*d* to 14*f* (see FIG. 5B) arranged near the heat-transfer-pipe-side lateral partition plate 32 (see FIG. 2)). As a result, the working fluid (refrigerant) accumulated on the inlet-pipe-side lateral partition plate 31 and the heat-transfer-pipe-side lateral partition plate 32 (see FIG. 2) is also distributed to each heat transfer pipe 14.

As described above, the header 16 distributes the entire working fluid (the entire refrigerant) to each heat transfer pipe 14. The flow of the entire working fluid (refrigerant) inside the header 16 as described above is a gently-dropping flow (see an arrow D11). The header 16 can generate the flow of the working fluid (refrigerant) circulating in a plane vertical to the section of each heat transfer pipe 14.

<Main Characteristics of Outdoor Heat Exchanger>

The outdoor heat exchanger 6 according to the first embodiment has the following characteristics.

(1) The outdoor heat exchanger 6 is configured such that the longitudinal partition plate 21 is provided inside the header 16 to rapidly deflect the flow of the gas-liquid two-phase working fluid (refrigerant) having flowed into the header 16.

In the outdoor heat exchanger 6 described above, the internal space of the header 16 is divided into the inlet-pipe-side upper space 33F (a near side of FIG. 4) and the heat-transfer-pipe-side upper space 33R (the far side of FIG. 4) by the longitudinal partition plate 21. Moreover, the outdoor heat exchanger 6 rapidly deflects, by the longitudinal partition plate 21, the flow of the gas-liquid two-phase working fluid (refrigerant) having flowed into the header 16. With this configuration, the outdoor heat exchanger 6 can minimize the influence of the speed difference between the liquid and the gas contained in the gas-liquid two-phase working fluid (refrigerant), and can reduce the imbalanced liquid flow. Consequently, the outdoor heat exchanger 6 can reduce occurrence of the drift of the working fluid (refrigerant) inside the header.

(2) The outdoor heat exchanger 6 is configured such that the opening 21*op* is provided at a position (a position shifted from an axial direction of the inlet pipe 18) not overlapping with the inlet pipe 18. That is, in the outdoor heat exchanger 6, the opening 21*op* is provided at a position (the position at the side of the opposing portion 18*tg* (see FIG. 3A)) of the longitudinal partition plate 21 not colliding with the working fluid (refrigerant) having flowed into the header 16. Moreover, the opening 21*op* is formed to extend in the upper-to-lower direction.

The outdoor heat exchanger 6 described above can generate the flow of the working fluid (refrigerant) circulating in the plane vertical to the section of each heat transfer pipe 14. Moreover, in the outdoor heat exchanger 6, the gas-liquid two-phase working fluid (refrigerant) gently drops inside the header 16 by the force of gravity, and therefore, the liquid and the gas of the working fluid (refrigerant) can be mixed efficiently. With this configuration, the outdoor heat exchanger 6 can also reduce occurrence of the drift of the working fluid (refrigerant) inside the header 16.

(3) In the outdoor heat exchanger 6, the inlet pipe 18 is arranged at the relatively-high position of the header 16 for gently dropping the gas-liquid two-phase working fluid (refrigerant) inside the header 16 by the force of gravity. Moreover, the outdoor heat exchanger 6 has, for reliably distributing the working fluid (refrigerant) to each heat transfer pipe 14, such a structure that the lateral partition plate 30 (the inlet-pipe-side lateral partition plate 31 and the heat-transfer-pipe-side lateral partition plate 32) is provided inside the header 16 and the working fluid (refrigerant) is accumulated on the lateral partition plate 30.

The outdoor heat exchanger 6 described above can distribute the working fluid (refrigerant) to all of the heat transfer pipes 14. Moreover, the outdoor heat exchanger 6 is configured such that the working fluid (refrigerant) is accumulated on the lateral partition plate 30, and therefore, the dropping speed of the working fluid (refrigerant) can be decreased. Thus, the liquid and the gas of the working fluid (refrigerant) can be mixed efficiently. With this configuration, the outdoor heat exchanger 6 can also reduce occurrence of the drift of the working fluid (refrigerant) inside the header 16.

In the outdoor heat exchanger 6 described above, distribution of the working fluid (refrigerant) to each heat transfer pipe 14 can be brought close to a uniform state specifically in the case of performing the evaporation operation. With this configuration, the outdoor heat exchanger 6 allows the gas-liquid two-phase refrigerant to substantially uniformly flow in the multiple heat transfer pipes 14. Thus, the outdoor heat exchanger 6 can improve the performance for distributing the working fluid (refrigerant) from the header to each heat transfer pipe 14. The outdoor heat exchanger 6 described above can reduce occurrence of the drift of the working fluid (refrigerant) inside the header 16. As a result, the outdoor heat exchanger 6 can also reduce overheating of a specific heat transfer pipe 14 and degradation of heat exchange performance.

As described above, according to the outdoor heat exchanger 6 of the first embodiment, the performance for distributing the working fluid (refrigerant) from the header 16 to each heat transfer pipe 14 can be improved.

Second Embodiment

The outdoor heat exchanger 6 (see FIG. 2) according to the first embodiment has such a structure that the working fluid (refrigerant) having flowed from the header 16 side to a header 17 side is returned to the header 16 side by the header 17.

On the other hand, in the second embodiment, an outdoor heat exchanger 6A is provided, which has such a structure that after working fluid (refrigerant) has repeatedly flowed between a header 16*a* and a header 17*a*, the working fluid (refrigerant) is sent from the header 17*a* to external equipment.

Figure 6:
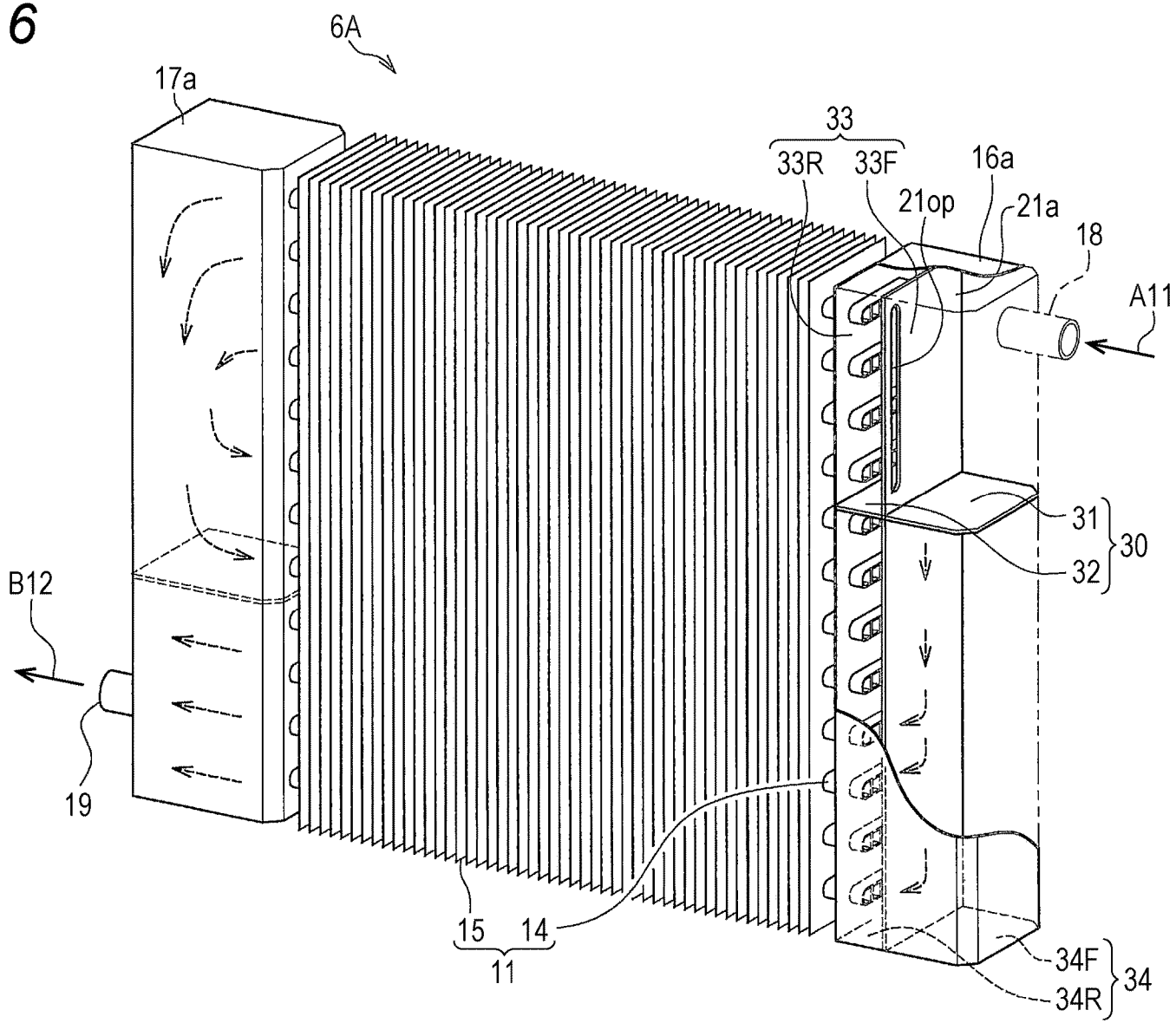
FIG. 6 is a view of a configuration of an outdoor heat exchanger according to a second embodiment.

Hereinafter, a configuration of the outdoor heat exchanger 6A according to the second embodiment will be described with reference to FIG. 6. FIG. 6 is a view of the configuration of the outdoor heat exchanger 6A according to the second embodiment.

As illustrated in FIG. 6, the outdoor heat exchanger 6A according to the second embodiment is different from the outdoor heat exchanger 6 (see FIG. 2) according to the first embodiment in that the header 16*a* and the header 17*a* are provided instead of the headers 16, 17.

The header 16*a* is different from the header 16 (see FIG. 2) of the first embodiment in that an inlet pipe 18 and heat transfer pipes 14 are connected to the header 16*a*, but an outlet pipe 19 is not connected to the header 16*a* and a longitudinal partition plate 21*a* is used instead of the longitudinal partition plate 21.

As in the longitudinal partition plate 21 (see FIG. 2) of the first embodiment, the longitudinal partition plate 21*a* is a plate-shaped member configured to separate an inlet-pipe-side upper space 33F and a heat-transfer-pipe-side upper space 33R. Note that the length of the longitudinal partition plate 21*a* is shorter than that of the longitudinal partition plate 21 (see FIG. 2) of the first embodiment. The longitudinal partition plate 21*a* is in a substantially flat shape on both surfaces.

The header 17*a* is different from the header 17 (see FIG. 2) of the first embodiment in that an outlet pipe 19 is connected to the header 17*a* in addition to the heat transfer pipes 14 and the working fluid (refrigerant) is sent from the header 17*a* to the external equipment after having repeatedly (a single round in an illustrated example) flowed between the header 16*a* and the header 17*a*. Note that in the headers 16*a*, 17*a*, the working fluid (refrigerant) flows along a solid arrow and a dashed arrow.

As in the outdoor heat exchanger 6 of the first embodiment, the outdoor heat exchanger 6A described above has the characteristics (1) to (3) described in the chapter of "Main Characteristics of Outdoor Heat Exchanger" in the first embodiment. Thus, the outdoor heat exchanger 6A can provide features and advantageous effects similar to those of the outdoor heat exchanger 6 of the first embodiment.

As described above, according to the outdoor heat exchanger 6A of the second embodiment, performance for distributing the working fluid (refrigerant) from the header 16*a* to each heat transfer pipe 14 can be improved as in the outdoor heat exchanger 6 according to the first embodiment. Moreover, according to the outdoor heat exchanger 6A, the working fluid (refrigerant) can be sent from the header 16*b* to the external equipment as compared to the outdoor heat exchanger 6 according to the first embodiment.

Third Embodiment

The outdoor heat exchanger 6 (see FIG. 2) according to the first embodiment has such a structure that the single heat exchange section 11 is used.

On the other hand, in a third embodiment, an outdoor heat exchanger 6B having a structure using two heat exchange sections 11, 12 is provided.

Figure 7:
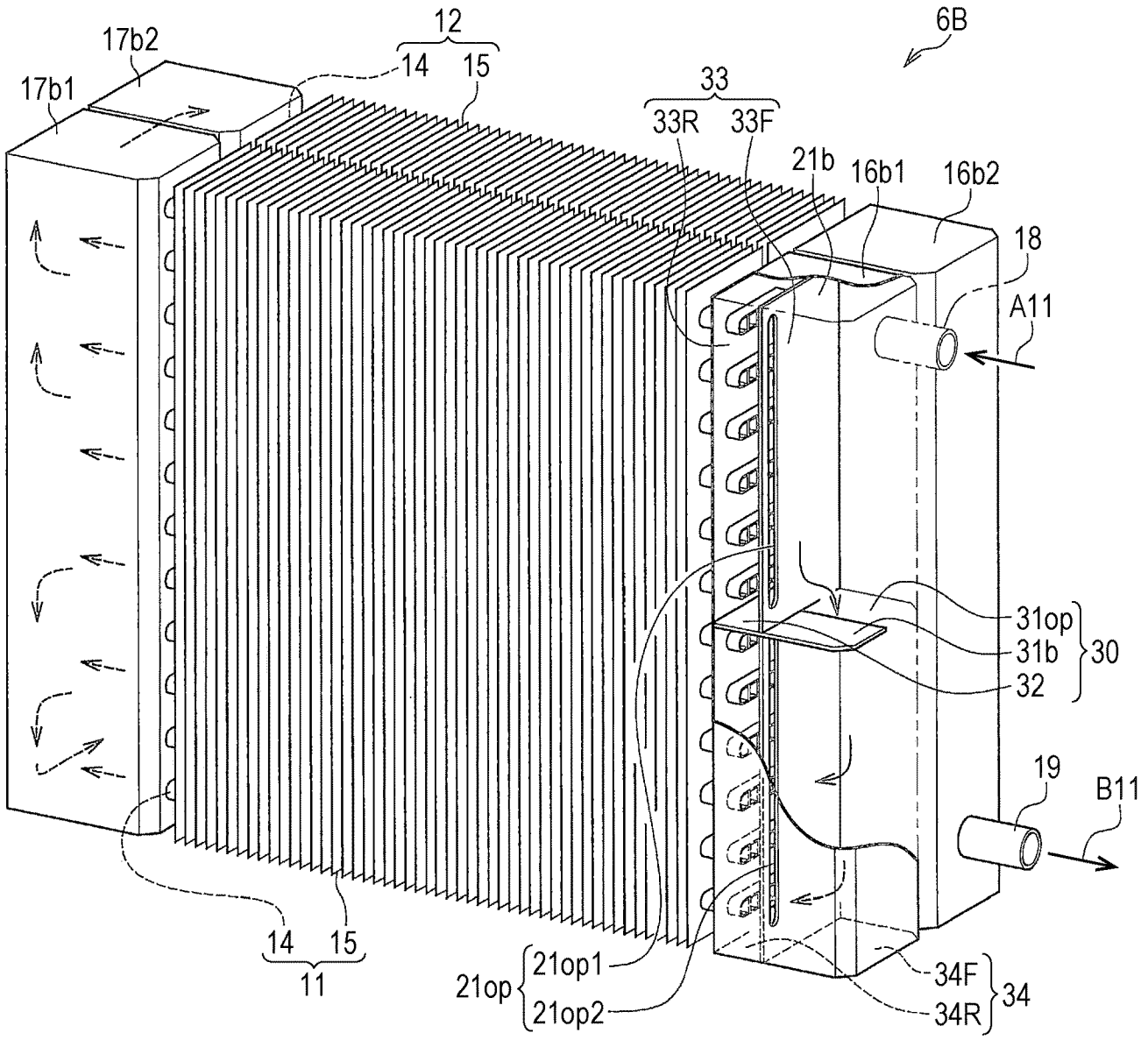
FIG. 7 is a view of a configuration of an outdoor heat exchanger according to a third embodiment.
Figure 8:
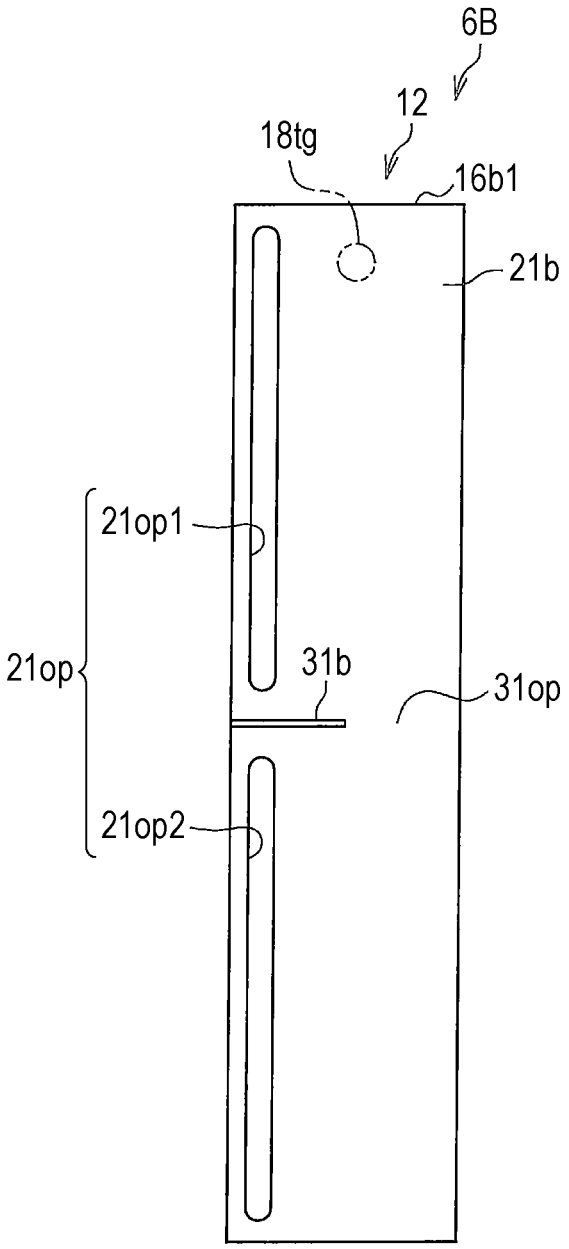
FIG. 8 is a view of an internal structure of a header of the outdoor heat exchanger according to the third embodiment.

Hereinafter, a configuration of the outdoor heat exchanger 6B according to the third embodiment will be described with reference to FIGS. 7 and 8. FIG. 7 is a view of the configuration of the outdoor heat exchanger 6B according to the third embodiment. FIG. 8 is a view of an internal structure of a header 16*b*1 of the outdoor heat exchanger 6B according to the third embodiment.

As illustrated in FIG. 7, the outdoor heat exchanger 6B according to the third embodiment is different from the outdoor heat exchanger 6 (see FIG. 2) according to the first embodiment in that the outdoor heat exchanger 6B has the structure using two heat exchange sections 11, 12.

The heat exchange section 12 has a configuration similar to that of the heat exchange section 11, and has multiple heat transfer pipes 14 and multiple fins 15.

One end portion of the heat exchange section 11 is connected to the header 16*b*1 through the heat transfer pipes 14, and the other end portion of the heat exchange section 11 is connected to a header 17*b*1 through the heat transfer pipes 14. Moreover, one end portion of the heat exchange section 12 is connected to a header 16*b*2 through the heat transfer pipes 14, and the other end portion of the heat exchange section 12 is connected to a header 17*b*2 through the heat transfer pipes 14.

An inlet pipe 18 and the heat transfer pipes 14 of the heat exchange section 11 are connected to the header 16*b*1 on a heat exchange section 11 side. Moreover, a connection pipe (not shown) for the header 17*b*2 on a heat exchange section 12 side and the heat transfer pipes 14 of the heat exchange section 11 are connected to the header 17*b*1 on the heat exchange section 11 side. That is, the header 17*b*1 and the header 17*b*2 are connected to each other. Working fluid (refrigerant) having flowed from the heat transfer pipes 14 of the heat exchange section 11 to the header 17*b*1 flows toward the header 17*b*2, and then, flows out to the header 16*b*2 through the heat transfer pipes 14 of the heat exchange section 12.

On the other hand, an outlet pipe 19 and the heat transfer pipes 14 of the heat exchange section 12 are connected to the header 16*b*2 on the heat exchange section 12 side. Moreover, a connection pipe (not shown) for the header 17*b*1 on the heat exchange section 11 side and the heat transfer pipes 14 of the heat exchange section 12 are connected to the header 17*b*2 on the heat exchange section 12 side.

In the outdoor heat exchanger 6B, the working fluid (refrigerant) having flowed into the header 16*b*1 through an internal flow path of the inlet pipe 18 along the direction of an arrow A11 is sent in the order of the header 17*b*1, the header 17*b*2, and the header 16*b*2 from the header 16*b*1. Note that in the headers 16*b*1, 17*b*1, the working fluid (refrigerant) flows along a solid arrow and a dashed arrow. Moreover, the outdoor heat exchanger 6B sends the working fluid (refrigerant) to external equipment through an internal flow path of the outlet pipe 19 along the direction of an arrow B11.

In the header 16*b*1 on the heat exchange section 11 side, a longitudinal partition plate 21*b* and a lateral partition plate 30 are provided.

The longitudinal partition plate 21*b* is a plate-shaped member configured not only to separate an upper space 33 of the header 16*b*1 but also to divide a lower space 34 into an inlet-pipe-side lower space 34F and a heat-transfer-pipe-side lower space 34R. The longitudinal partition plate 21*b* is in a substantially flat shape on both surfaces. The longitudinal partition plate 21*b* is arranged to extend not only in the upper space 33 but also in the lower space 34. Two elongated hole-shaped openings 21*op*1, 21*op*2 extending in an upper-to-lower direction are each provided at upper and lower portions of the longitudinal partition plate 21*b* with respect to the lateral partition plate 30. The longitudinal partition plate 21*b* allows the working fluid (refrigerant) to flow between an inlet-pipe-side upper space 33F and a heat-transfer-pipe-side upper space 33R through the opening 21*op*1. Moreover, the longitudinal partition plate 21*b* allows the working fluid (refrigerant) to flow between the inlet-pipe-side lower space 34F and the heat-transfer-pipe-side lower space 34R through the opening 21*op*2.

In the third embodiment, the lateral partition plate 30 includes an inlet-pipe-side lateral partition plate 31*b* and a heat-transfer-pipe-side lateral partition plate 32. The inlet-pipe-side lateral partition plate 31*b* is joined to the longitudinal partition plate 21*b*. As illustrated in FIGS. 7 and 8, the inlet-pipe-side lateral partition plate 31*b* is a plate-shaped member configured such that an opening 31*op* is partially formed. The opening 31*op* functions as a buffer flow path for slightly throttling the flow of working fluid (refrigerant) dropping from above to supply the working fluid (refrigerant) downward. The opening 31*op* is provided apart from the openings 21*op*1, 21*op*2.

Note that the opening (the opening 31*op* in this case) functioning as the buffer flow path is provided only at the inlet-pipe-side lateral partition plate 31*b*, and is not provided at the heat-transfer-pipe-side lateral partition plate 32. This is because the heat-transfer-pipe-side lateral partition plate 32 is a member intended for accumulation of the working fluid (refrigerant) on the heat-transfer-pipe-side lateral partition plate 32 and distribution of the accumulated working fluid (refrigerant) to each heat transfer pipe 14.

The inlet-pipe-side lateral partition plate 31*b* slightly throttles, at the opening 31*op*, the flow of working fluid (refrigerant) dropping from above after having collided with the longitudinal partition plate 21 at an opposing portion 18*tg* (see FIG. 8) for the inlet pipe 18, and then, supplies the working fluid (refrigerant) downward. In this state, the inlet-pipe-side lateral partition plate 31*b* functions as a stopper configured to decrease the dropping speed of the working fluid (refrigerant) to adjust such a speed to a suitable dropping speed.

Note that in the third embodiment, only the single inlet-pipe-side lateral partition plate 31*b* and the single heat-transfer-pipe-side lateral partition plate 32 (see FIG. 7) are provided at the header 16*b*1. However, multiple inlet-pipe-side lateral partition plates 31*b* and multiple heat-transfer-pipe-side lateral partition plates 32 (see FIG. 7) may be provided at the header 16*b*1. In this case, the header 16*b*1 can decrease the dropping speed of the working fluid (refrigerant) at multiple stages by each inlet-pipe-side lateral partition plate 31*b*, and can adjust such a speed to the suitable dropping speed. Note that in this case, the multiple inlet-pipe-side lateral partition plates 31*b* and the multiple heat-transfer-pipe-side lateral partition plates 32 (see FIG. 7) may be arranged in a staggered pattern (a zigzag pattern).

As in the outdoor heat exchanger 6 of the first embodiment, the outdoor heat exchanger 6B described above has the characteristics (1) to (3) described in the chapter of "Main Characteristics of Outdoor Heat Exchanger" in the first embodiment. Thus, the outdoor heat exchanger 6B can provide features and advantageous effects similar to those of the outdoor heat exchanger 6 of the first embodiment.

<Variations of Header>

For example, as illustrated in FIGS. 9A, 9B, 10A, and 10B, the header 16*b*1 can be modified. Hereinafter, variations of the header 16*b*1 will be described with reference to FIGS. 9A, 9B, 10A, and 10B. FIGS. 9A, 9B, 10A, and 10B are each views of the variations of the header 16*b*1.

Figure 9A:
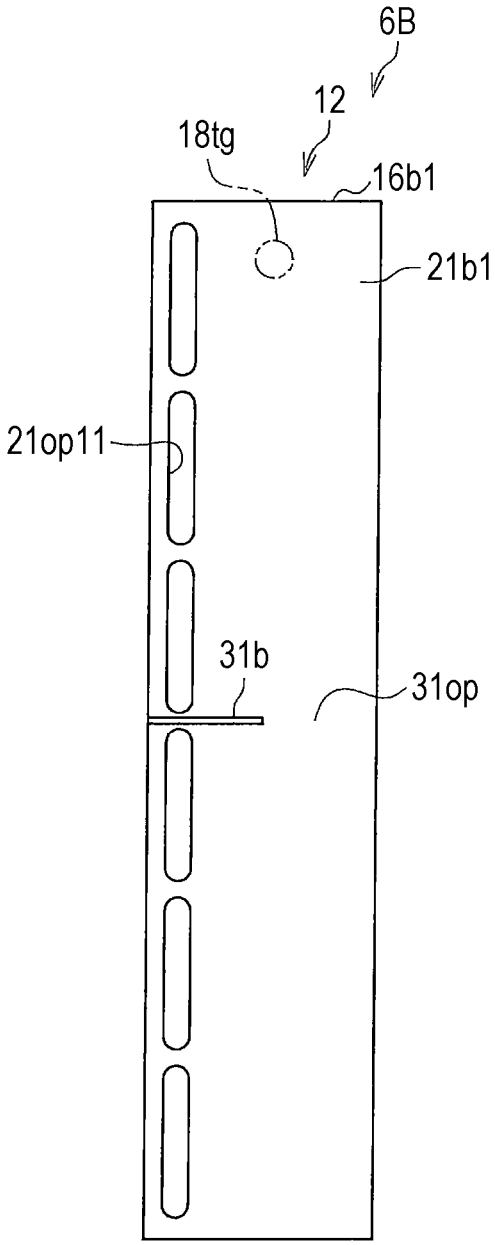
FIGS. 9A and 9B are views of variations of the header of the outdoor heat exchanger according to the third embodiment (1)

FIG. 9A illustrates, as the variation of the header 16*b*1, an example where a longitudinal partition plate 21*b*1 is used instead of the longitudinal partition plate 21*b* (see FIG. 8). The longitudinal partition plate 21*b*1 is a plate-shaped member configured such that six elongated hole-shaped openings 21*op*11 having a shorter length (longitudinal width) than those of the openings 21*op*1, 21*op*2 are formed instead of two elongated hole-shaped openings 21*op*1, 21*op*2 (see FIG. 8).

Figure 9B:
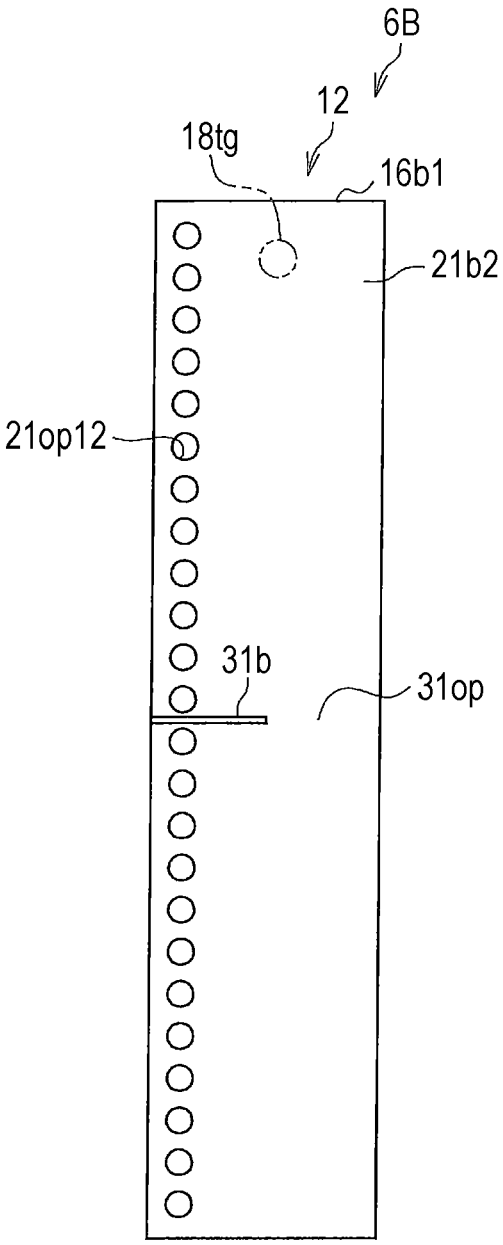

FIG. 9B illustrates, as the variation of the header 16*b*1, an example where a longitudinal partition plate 21*b*2 is used instead of the longitudinal partition plate 21*b* (see FIG. 8). The longitudinal partition plate 21*b*2 is a plate-shaped member configured such that many circular openings 21*op*12 are formed instead of two elongated hole-shaped openings 21*op*1, 21*op*2 (see FIG. 8).

Figure 10A:
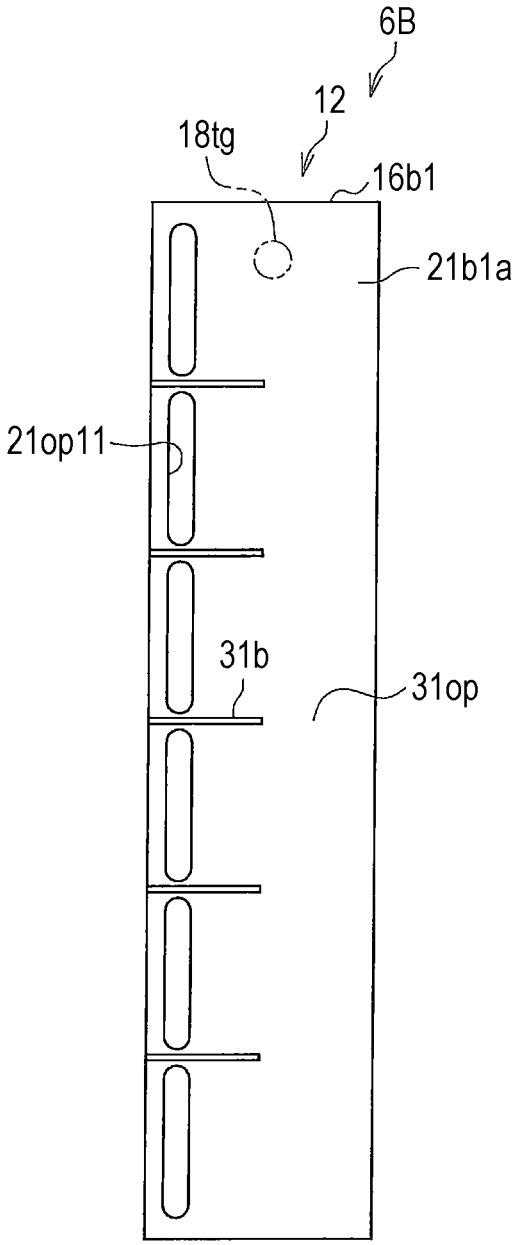
FIGS. 10A and 10B are views of variations of the header of the outdoor heat exchanger according to the third embodiment (2)

FIG. 10A illustrates, as the variation of the header 16*b*1, an example where a longitudinal partition plate 21*b*1*a* is used instead of the longitudinal partition plate 21*b* (see FIG. 8). The longitudinal partition plate 21*b*1*a* is a plate-shaped member configured such that six elongated hole-shaped openings 21*op*11 having a shorter length (longitudinal width) than those of the openings 21*op*1, 21*op*2 are formed instead of two elongated hole-shaped openings 21*op*1, 21*op*2 (see FIG. 8) and five inlet-pipe-side lateral partition plates 31*b* are joined. Note that although not shown in the figure, the longitudinal partition plate 21*b*1*a* is configured such that five heat-transfer-pipe-side lateral partition plates 32 are joined to a back side of positions at which five inlet-pipe-side lateral partition plates 31*b* are joined.

Figure 10B:
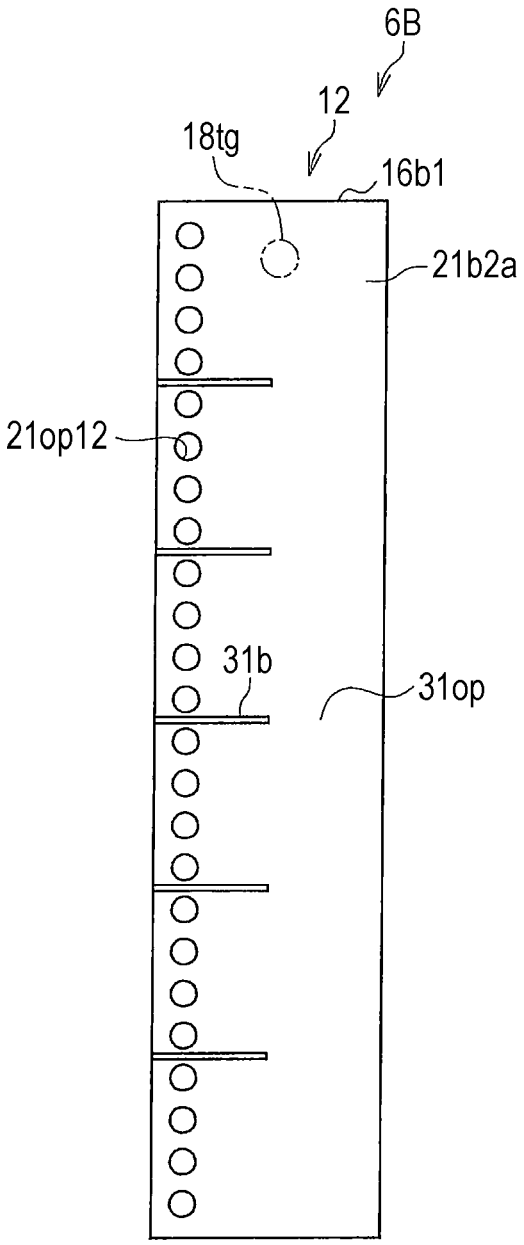

FIG. 10B illustrates, as the variation of the header 16*b*1, an example where a longitudinal partition plate 21*b*2*a* is used instead of the longitudinal partition plate 21*b* (see FIG. 8). The longitudinal partition plate 21*b*2*a* is a plate-shaped member configured such that many circular openings 21*op*12 are formed instead of two elongated hole-shaped openings 21*op*1, 21*op*2 (see FIG. 8) and five inlet-pipe-side lateral partition plates 31*b* are joined. Note that although not shown in the figure, the longitudinal partition plate 21*b*2*a* is configured such that five heat-transfer-pipe-side lateral partition plates 32 are joined to a back side of positions at which five inlet-pipe-side lateral partition plates 31*b* are joined.

As described above, according to the outdoor heat exchanger 6B of the third embodiment, performance for distributing the working fluid (refrigerant) from the header 16*b*1 to each heat transfer pipe 14 can be improved as in the outdoor heat exchanger 6 according to the first embodiment. In addition, according to the outdoor heat exchanger 6B of the third embodiment, the heat exchange section 12 is provided in addition to the heat exchange section 11, and therefore, heat exchange performance can be improved as compared to the outdoor heat exchanger 6 according to the first embodiment.

Fourth Embodiment

<Configuration of Indoor Heat Exchanger>

Figure 11:
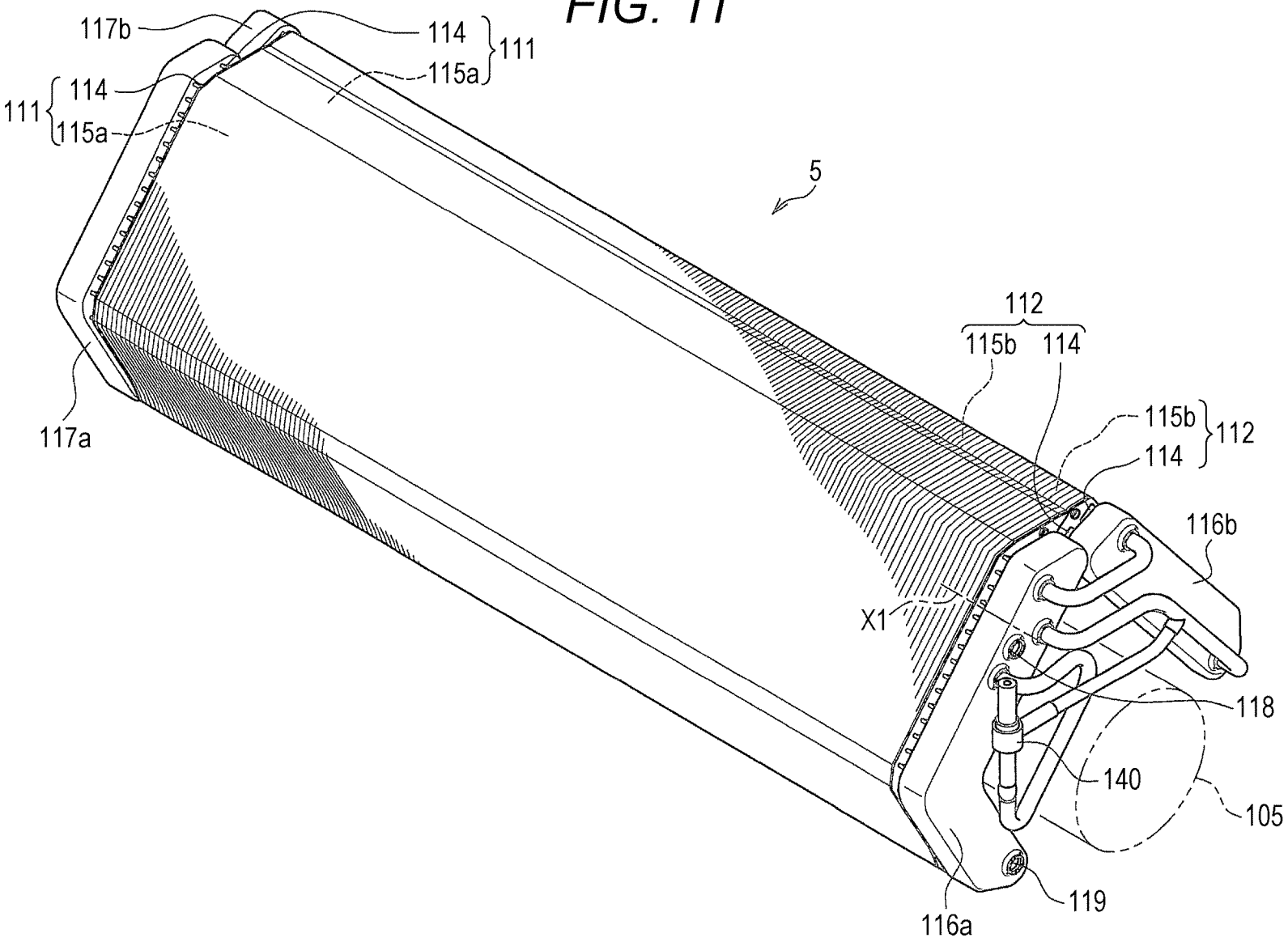
FIG. 11 is a view of a configuration of an indoor heat exchanger according to a fourth embodiment.
Figure 12A:
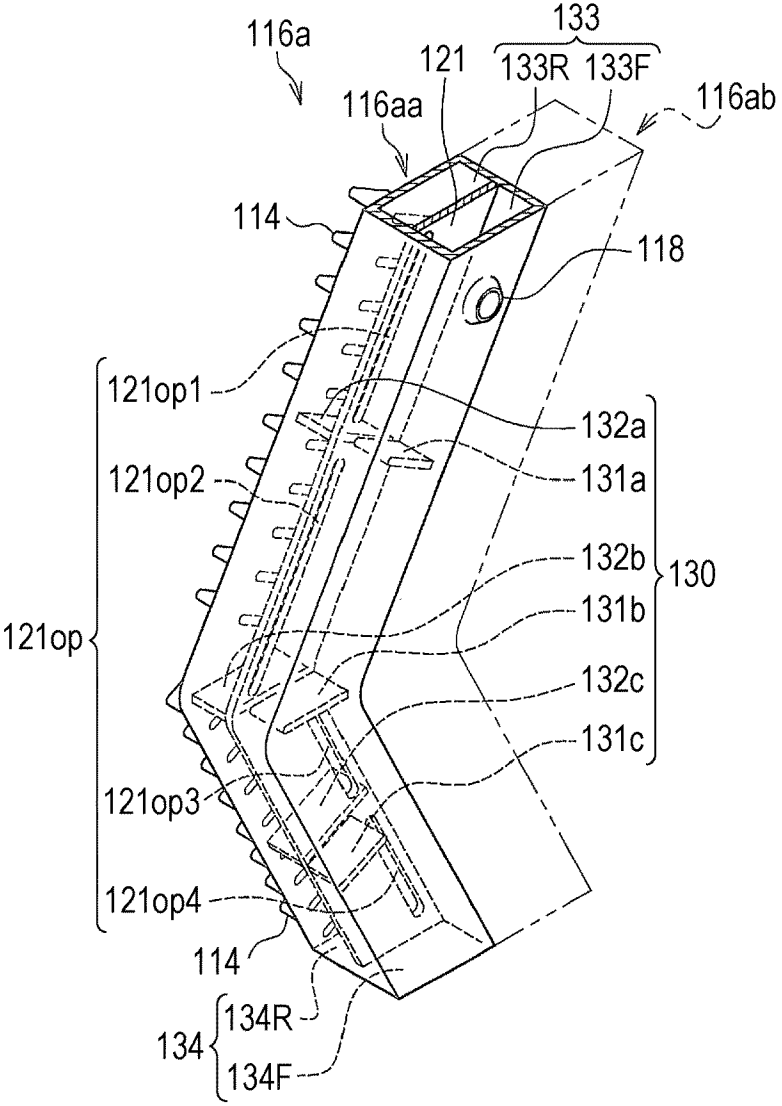
FIGS. 12A to 12C are views of an internal structure of a header of the indoor heat exchanger according to the fourth embodiment.
Figure 12B:
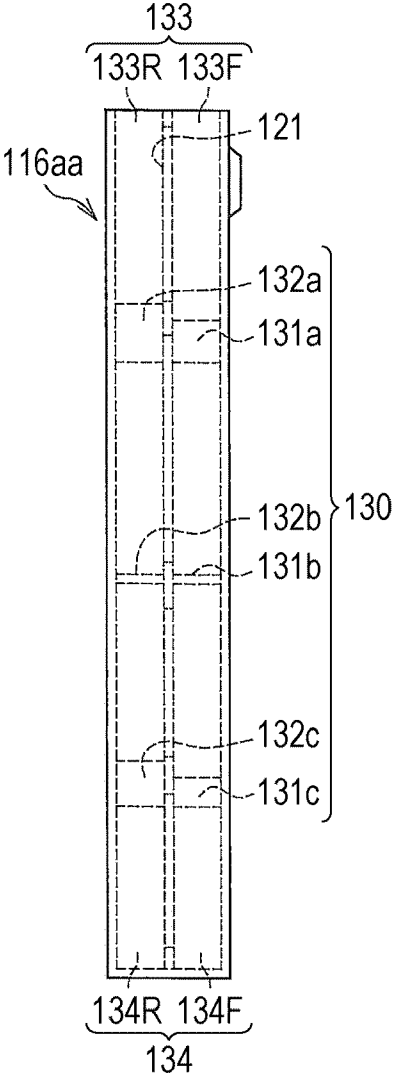
Figure 12C:
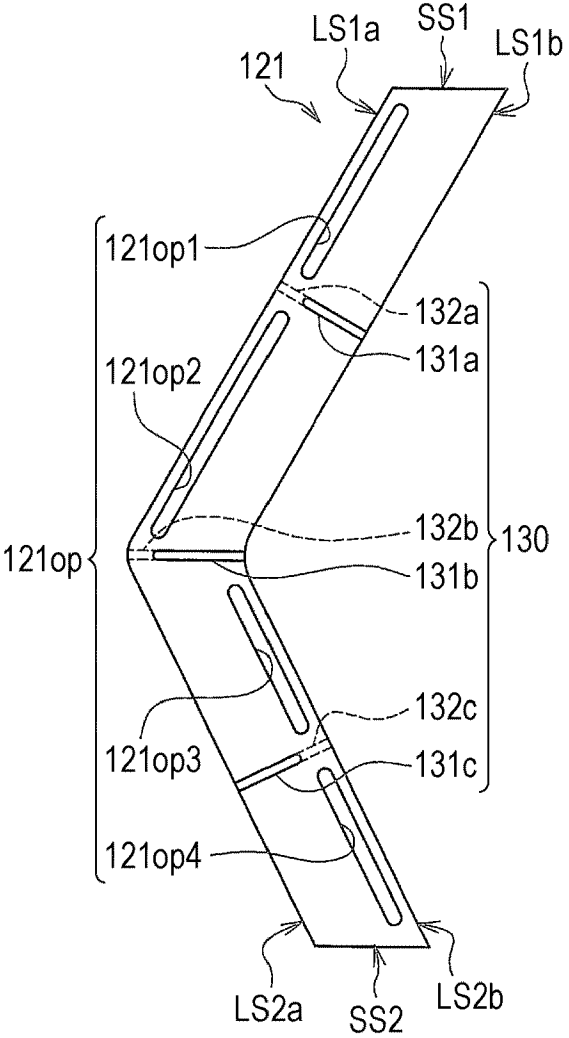

A fourth embodiment is an embodiment applied to an indoor heat exchanger 5. Hereinafter, a configuration of the indoor heat exchanger 5 according to the fourth embodiment will be described with reference to FIGS. 11 and 12A to 12C. FIG. 11 is a view of the configuration of the indoor heat exchanger 5 according to the fourth embodiment. FIGS. 12A to 12C are views of an internal structure of a header 116*a* of the indoor heat exchanger 5 according to the fourth embodiment. FIG. 12A illustrates an obliquely-viewed sectional structure of the header 116*a* along a line X1 illustrated in FIG. 11, FIG. 12B illustrates a front sectional structure of the header 116*a*, and FIG. 12C illustrates a structure of a longitudinal partition plate 121 used for the header 116*a*.

As illustrated in FIG. 11, the indoor heat exchanger 5 according to the fourth embodiment includes an air blower 105, front heat exchange sections 111 arranged on a front side of the air blower 105, and back heat exchange sections 112 arranged on an upper back side of the air blower 105. The front heat exchange section 111 and the back heat exchange section 112 are mechanisms configured to perform heat exchange between working fluid (refrigerant) and indoor air. The case of performing cooling operation by an air-conditioner 1 (i.e., the indoor heat exchanger 5 performs evaporation operation, and an outdoor heat exchanger 6 performs condensation operation) will be assumed and described herein.

The front heat exchange section 111 has multiple heat transfer pipes 114 for supplying the refrigerant and multiple fins 115*a* for expanding a heat transfer surface. On the other hand, the back heat exchange section 112 has multiple heat transfer pipes 114 for supplying the refrigerant and multiple fins 115*b* for expanding the heat transfer surface.

The fin 115*a* of the front heat exchange section 111 is in a shape bent in the vicinity of the substantially center in a height direction. On the other hand, the fin 115*b* of the back heat exchange section 112 is in a substantially straight shape.

One end portion of the front heat exchange section 111 is connected to the header 116*a* through the heat transfer pipes 114, and the other end portion of the front heat exchange section 111 is connected to a header 117*a*. Moreover, one end portion of the back heat exchange section 112 is connected to a header 116*b* through the heat transfer pipes 114, and the other end portion of the back heat exchange section 112 is connected to a header 117*b*.

Note that the fourth embodiment describes such a structure that the indoor heat exchanger 5 has two rows of the front heat exchange sections 111 arranged in parallel and two rows of the front heat exchange sections 111 are connected to the single header 116*a* and the single header 117*a*. That is, a structure is described, in which two rows of the fins 115*a* are arranged in parallel and are connected to the single header 116*a* and the single header 117*a* through the heat transfer pipes 114.

Moreover, it is described that the indoor heat exchanger 5 has two rows of the back heat exchange sections 112 arranged in parallel and two rows of the back heat exchange sections 112 are connected to the single header 116*b* and the single header 117*b*. That is, a structure is described, in which two rows of the fins 115*b* are arranged in parallel and are connected to the single header 116*b* and the single header 117*b* through the heat transfer pipes 114.

The headers 116*a*, 116*b*, 117*a*, 117*b* are containers configured to temporarily store the working fluid (refrigerant).

In the headers 116*a*, 116*b*, 117*a*, 117*b*, spaces for temporarily storing the working fluid (refrigerant) are provided.

The headers 116*a*, 116*b* are in a shape bent in the vicinity of the substantially center in the height direction in accordance with the shape of the fin 115*a* of the front heat exchange section 111. On the other hand, the headers 117*a*, 117*b* are is a substantially straight shape in accordance with the shape of the fin 115*b* of the back heat exchange section 112.

The header 116*a* on a front heat exchange section 111 side is connected to a pipe 118 (hereinafter referred to as an "inlet pipe 118") functioning as an inlet pipe for supplying the working fluid (refrigerant) from an outdoor heat exchanger 6 side to an indoor heat exchanger 5 side in the cooling operation (the evaporation operation of the indoor heat exchanger 5), a pipe 119 (hereinafter, referred to as an "outlet pipe 119") functioning as an outlet pipe for supplying the working fluid (refrigerant) from the indoor heat exchanger 5 side to the outdoor heat exchanger 6 side in the cooling operation (the evaporation operation of the indoor heat exchanger 5), and the heat transfer pipes 114 of the front heat exchange sections 111. Note that the functions of the pipe 118 and the pipe 119 are inverted in heating operation (condensation operation of the indoor heat exchanger 5) (i.e., the pipe 118 serves as the outlet pipe, and the pipe 119 serves as the inlet pipe). Moreover, the header 117*a* on the front heat exchange section 111 side is connected to a connection pipe (not shown) for the header 117*b* on a back heat exchange section 112 side and the heat transfer pipes 114 of the front heat exchange sections 111.

On the other hand, the header 116*b* on the back heat exchange section 112 side is connected to the heat transfer pipes 114 of the back heat exchange sections 112. Moreover, the header 117*b* on the back heat exchange section 112 side is connected to a connection pipe (not shown) for the header 117*a* on the front heat exchange section 111 side and the heat transfer pipes 114 of the back heat exchange sections 112.

Each heat transfer pipe 114 is in an oval shape or a flat shape, and is joined to penetrate each fin 115. An end portion of each heat transfer pipe 114 is inserted into the headers 116*a*, 116*b*, 117*a*, 117*b*. The end portion of each heat transfer pipe 114 opens in internal spaces of the headers 116*a*, 116*b*, 117*a*, 117*b*.

Note that a dehumidification mechanism 140 configured to perform dehumidification processing is connected to between the header 116*a* on the front heat exchange section 111 side and the header 116*b* on the back heat exchange section 112 side.

As illustrated in FIG. 12A, the header 116*a* has such a structure that two rows of headers 116*aa*, 116*ab* are joined corresponding to two rows of the front heat exchange sections 111. The header 116*aa* of the first row (a near side) is connected to the fins 115*a* (see FIG. 11) of the first row (the near side) through the heat transfer pipes 114. On the other hand, the header 116*ab* of the second row (a far side) is connected to the fins 115*a* (see FIG. 11) of the second row (the far side) through the heat transfer pipes 114. The headers 116*aa*, 116*ab* of the second rows have similar structures. The structure will be described with reference to the header 116*aa* as an example.

As illustrated in FIGS. 12A and 12B, a longitudinal partition plate 121 and a lateral partition plate 130 are provided inside the header 116*aa*.

The longitudinal partition plate 121 is a plate-shaped member configured to divide an internal space of the header 116*aa* into an inlet-pipe-side space and a heat-transfer-pipe-side space. The longitudinal partition plate 121 divides an upper space 133 in the header 116*aa* into an inlet-pipe-side upper space 133F and a heat-transfer-pipe-side upper space 133R. Moreover, the longitudinal partition plate 121 divides a lower space 134 in the header 116*aa* into an inlet-pipe-side lower space 134F and a heat-transfer-pipe-side lower space 134R.

As illustrated in FIG. 12C, the longitudinal partition plate 121 is in a shape having two short sides SS1, SS2 and two or more long sides (in an illustrated example, four long sides LS1*a*, LS1*b*, LS2*a*, LS2*b*) crossing in an inclined state with respect to the vertical direction and having a longer width than that of the short side. Of four long sides LS1*a*, LS1*b*, LS2*a*, LS2*b*, the long sides LS1*b*, LS2*a* are long sides (hereinafter referred to as "long sides in the direction of gravitational force") arranged in the direction of gravitational force with respect to the long sides LS1*a*, LS2*b*. On the other hand, the long sides LS1*a*, LS2*b* are long sides (hereinafter referred to as "long sides on the opposite side of the direction of gravitational force") arranged on the opposite side of the direction of gravitational force with respect to the long sides LS1*b*, LS2*a*. The "direction of gravitational force" described herein means the direction of flow of gas-liquid two-phase working fluid (refrigerant).

Returning to FIGS. 12A and 12B, the lateral partition plate 130 is a plate-shaped member configured to divide the internal space of the header 116*aa* into the upper and lower spaces at multiple stages (in the illustrated example, three stages). The lateral partition plate 130 is arranged to extend laterally or extend diagonally to a lateral side in the header 116*aa*.

The lateral partition plate 130 includes three inlet-pipe-side lateral partition plates 131*a*, 131*b*, 131*c* arranged in this order from the top on an inlet pipe 118 side with respect to the longitudinal partition plate 121, and three heat-transfer-pipe-side lateral partition plates 132*a*, 132*b*, 132*c* arranged in this order from the top on a heat transfer pipe 114 side with respect to the longitudinal partition plate 121. Three inlet-pipe-side lateral partition plates 131*a*, 131*b*, 131*c* and three heat-transfer-pipe-side lateral partition plates 132*a*, 132*b*, 132*c* are joined to the longitudinal partition plate 121.

Three inlet-pipe-side lateral partition plates 131*a*, 131*b*, 131*c* are arranged such that front end portions thereof face diagonally upward, laterally, or diagonally downward. The uppermost and lowermost inlet-pipe-side lateral partition plates 131*a*, 131*c* are in an arrangement relationship substantially parallel to the heat transfer pipes 114. The middle inlet-pipe-side lateral partition plate 131*b* is arranged in the substantially horizontal direction.

Note that for the multiple heat transfer pipes 114, a direction (an arrangement direction) is different between those arranged on an upper side and those arranged on a lower side. The heat transfer pipes 114 arranged on the upper side are configured such that front end portions thereof face diagonally upward, and on the other hand, the heat transfer pipes 114 arranged on the lower side are configured such that front end portions thereof face diagonally downward.

Three heat-transfer-pipe-side lateral partition plates 132*a*, 132*b*, 132*c* are arranged such that front end portions thereof face diagonally upward, laterally, or diagonally downward. The uppermost and lowermost heat-transfer-pipe-side lateral partition plates 132*a*, 132*c* are in an arrangement relationship substantially parallel to the heat transfer pipes 114. The middle heat-transfer-pipe-side lateral partition plate 132*b* is arranged in the substantially horizontal direction.

Hereinafter, the inlet-pipe-side lateral partition plates 131*a*, 131*b*, 131*c* will be collectively referred to as "inlet-pipe-side lateral partition plates 131" as necessary. Moreover, the heat-transfer-pipe-side lateral partition plates 132*a*, 132*b*, 132*c* will be collectively referred to as "heat-transfer-pipe-side lateral partition plates 132" as necessary.

The inlet-pipe-side lateral partition plate 131 is a member intended to function as a stopper configured to decrease the dropping speed of the working fluid (refrigerant) to adjust such a speed to a suitable dropping speed. Thus, the inlet-pipe-side lateral partition plate 131 is configured such that the length thereof is shorter than the widths of the short sides SS1, SS2 of the longitudinal partition plate 121 (see FIG. 12C). Moreover, the inlet-pipe-side lateral partition plate 131 is joined to the longitudinal partition plate at a position near the long sides LS1*b*, LS2*a* in the direction of gravitational force among four long sides LS1*a*, LS1*b*, LS2*a*, LS2*b* (see FIG. 12C).

On the other hand, the heat-transfer-pipe-side lateral partition plate 132 is a member intended for accumulation of the working fluid (refrigerant) on the heat-transfer-pipe-side lateral partition plate 132 and distribution of the accumulated working fluid (refrigerant) to each heat transfer pipe 114. Thus, the heat-transfer-pipe-side lateral partition plate 132 has the same length as the width (the width in a front-to-back direction) of the longitudinal partition plate 121. Moreover, the heat-transfer-pipe-side lateral partition plate 132 is arranged across an entire area between two opposing long sides (in the example illustrated in FIG. 12C, between the long side LS1*a* and the long side LS1*b* or between the long side LS2*a* and the long side LS2*b*) of the longitudinal partition plate 121.

Four elongated hole-shaped openings 121*op*1, 121*op*2, 121*op*3, 121*op*4 extending diagonally in an upper-to-lower direction are formed at the longitudinal partition plate 121. Hereinafter, the openings 121*op*1, 121*op*2, 121*op*3, 121*op*4 will be collectively referred to as "openings 121*op*" as necessary.

The opening 121*op* functions as a flow path for the working fluid (refrigerant). The longitudinal partition plate 121 allows the working fluid (refrigerant) to flow between the inlet-pipe-side upper space 133F and the heat-transfer-pipe-side upper space 133R and between the inlet-pipe-side lower space 134F and the heat-transfer-pipe-side lower space 134R through the openings 121*op*.

As illustrated in FIG. 12C, the opening 121*op* is a portion intended to function as a buffer flow path for slightly throttling, by the inlet-pipe-side lateral partition plate 131, the flow of working fluid (refrigerant) temporarily accumulated on the inlet-pipe-side lateral partition plate 131 to supply the working fluid (refrigerant) downward. Thus, the openings 121*op* are formed to extend diagonally in the upper-to-lower direction at positions of the longitudinal partition plate 121 near the long sides LS1*a*, LS2*b* on the opposite side of the direction of the gravitational force such that the openings 121*op* can be arranged above the working fluid (refrigerant) temporarily accumulated on the inlet-pipe-side lateral partition plates 131.

As in the outdoor heat exchanger 6 of the first embodiment, the indoor heat exchanger 5 described above has the characteristics (1) to (3) described in the chapter of "Main Characteristics of Outdoor Heat Exchanger" in the first embodiment. Thus, the indoor heat exchanger 5 can provide features and advantageous effects similar to those of the outdoor heat exchanger 6 of the first embodiment.

<Variations of Headers>

Figure 13B:
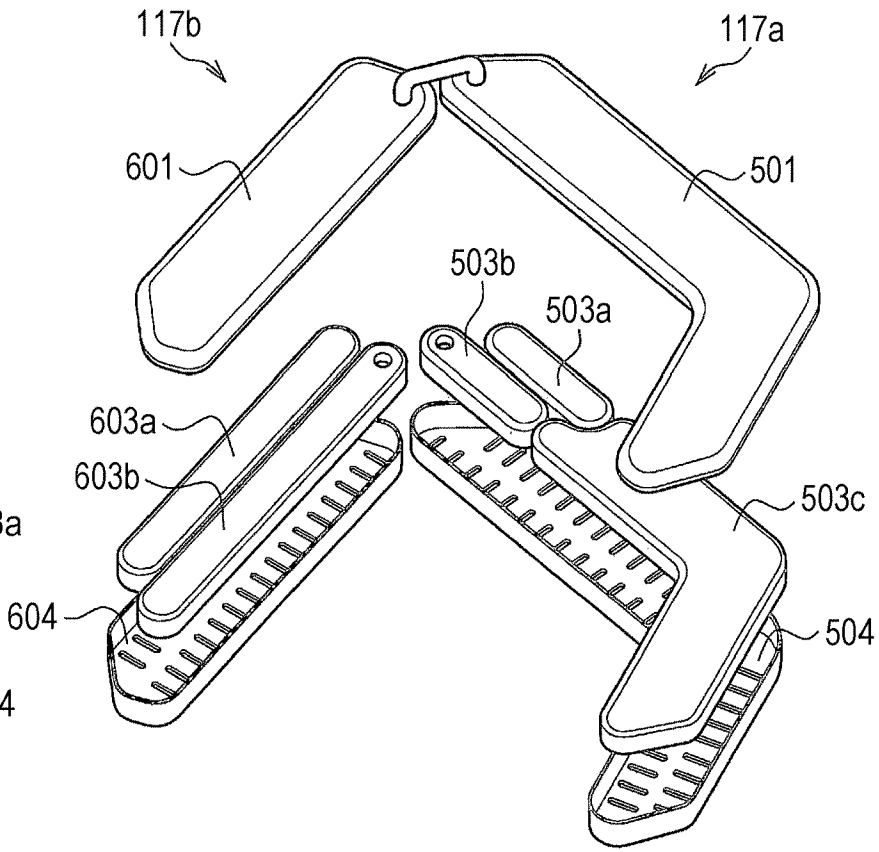
FIGS. 13A and 13B are views of variations of the header of the indoor heat exchanger according to the fourth embodiment.
Figure 13A:
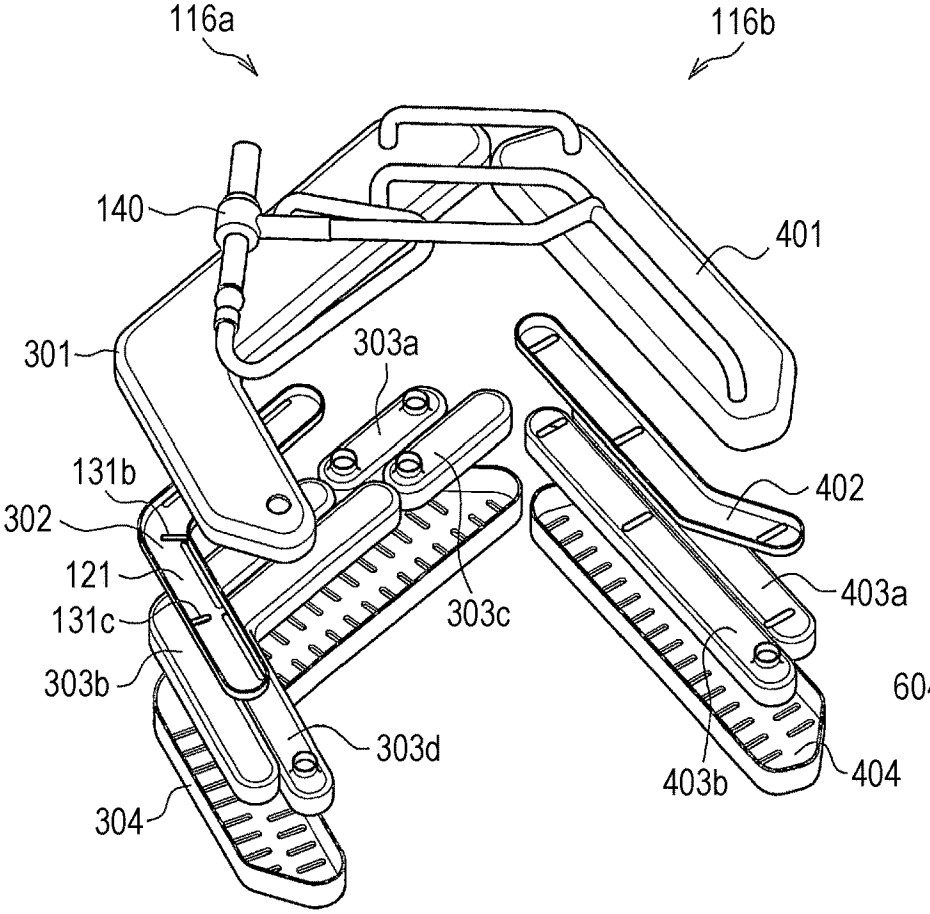

For example, as illustrated in FIGS. 13A and 13B, the headers 116*a*, 116*b*, 117*a*, 117*b* can be modified such that multiple members are combined to form the header 116*a*, 116*b*, 117*a*, 117*b*. Hereinafter, variations of the headers 116*a*, 116*b*, 117*a*, 117*b* will be described. FIGS. 13A and 13B are views of the variations of the headers 116*a*, 116*b*, 117*a*, 117*b*.

In examples illustrated in FIGS. 13A and 13B, the header 116*a* includes an exterior member 301 forming part of a housing, a partition member 302 fulfilling functions similar to those of the longitudinal partition plate 121, internal members 303*a*, 303*b*, 303*c*, 303*d* housed inside the housing, and an exterior member 304 forming part of the housing. The exterior member 304 is a member on a side connected to the heat transfer pipes 114. The header 116*a* is configured such that the internal members 303*a*, 303*b*, 303*c*, 303*d* are incorporated into the exterior member 304, the partition member 302 is arranged thereon, and the exterior member 304 and the exterior member 301 are joined to each other.

The header 116*b* includes an exterior member 401 forming part of a housing, a partition member 402 fulfilling functions similar to those of the longitudinal partition plate 121, internal members 403*a*, 403*b* housed inside the housing, and an exterior member 404 forming part of the housing. The exterior member 404 is a member on a side connected to the heat transfer pipes 114. The header 116*b* is configured such that the internal members 403*a*, 403*b* are incorporated into the exterior member 404, the partition member 402 is arranged thereon, and the exterior member 404 and the exterior member 401 are joined to each other.

The header 117*a* includes an exterior member 501 forming part of a housing, internal members 503*a*, 503*b*, 503*c* housed inside the housing, and an exterior member 504 forming part of the housing. The exterior member 504 is a member on a side connected to the heat transfer pipes 114. The header 117*a* is configured such that the internal members 503*a*, 503*b*, 503*c* are incorporated into the exterior member 504 and the exterior member 504 and the exterior member 501 are joined to each other.

The header 117*b* includes an exterior member 601 forming part of a housing, internal members 603*a*, 603*b* housed inside the housing, and an exterior member 604 forming part of the housing. The exterior member 604 is a member on a side connected to the heat transfer pipes 114. The header 117*b* is configured such that the internal members 603*a*, 603*b* are incorporated into the exterior member 604 and the exterior member 604 and the exterior member 601 are joined to each other.

As described above, according to the indoor heat exchanger 5 of the fourth embodiment, performance for distributing the working fluid (refrigerant) from the header 116*a* to each heat transfer pipe 114 can be improved.

The present embodiments are not limited to those described above, and include various modifications. For example, the above-described embodiments have been described in detail for the sake of simplicity in description of the present embodiments, and are not limited to one including all configurations described above. Moreover, some of configurations of a certain embodiment can be replaced with configurations of other embodiments, and configurations of other embodiments can be added to configurations of a certain embodiment. Further, addition/omission/replacement of other configurations can be made to some of configurations of each embodiment.

For example, in the fourth embodiment, the indoor heat exchanger 5 may be configured such that longitudinal partition plates similar to the longitudinal partition plate 121 are arranged in the headers 116*b*, 117*a*, 117*b* other than the header 116*a* after the longitudinal partition plates have been changed to such a shape that the longitudinal partition plate can be housed in each header.

Moreover, the outdoor heat exchangers 6, 6A, 6B according to the first to third embodiments may be, for example, configured such that multiple members are combined as in, e.g., the header 116*a* illustrated in FIGS. 13A and 13B.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A heat exchanger comprising:

multiple fins, each fin being planar and each having a main planar face extending in a longitudinal direction;

multiple heat transfer pipes joined to the fins and having an oval shape or a flat shape in cross-section; and a header connected, on one end side, to a cylindrical end portion of an inlet pipe, and the header is connected, on another end side, which is an opposite side to the end side, to respective end portions of each of the heat transfer pipes, wherein the header includes a longitudinal partition plate that is parallel to each main planar face of each of the multiple fins and is configured to divide an internal space of the header into an inlet-pipe-side space connected to the end portion of the inlet pipe and a heat-transfer-pipe-side space connected to the respective end portions of each of the heat transfer pipes, wherein the end portion of the inlet pipe is spaced from the longitudinal partition plate, and wherein an opening is disposed in the longitudinal partition plate and a projection of the axis of the cylindrical end portion of the inlet pipe does not intersect with the opening.

2. The heat exchanger according to claim 1, wherein the opening extends from a bottom portion of the longitudinal partition plate to a top portion of the longitudinal plate on a side of the longitudinal partition plate that is on an opposite side than a side facing the end portion of the inlet pipe.

3. The heat exchanger according to claim 1, wherein the projection of the axis of the cylindrical end portion of the inlet pipe intersects with a heat transfer pipe, from among the multiple heat transfer pipes, that is arranged at the highest position from among the multiple heat transfer pipes.

4. The heat exchanger according to claim 1, wherein an upper end of the opening is at a position higher than that of a heat transfer pipe, from among the multiple heat transfer pipes, that is arranged at the highest position from among the multiple heat transfer pipes.

5. The heat exchanger according to claim 1, wherein the opening includes multiple vertically-elongated holes or multiple circular holes.

6. The heat exchanger according to claim 1, wherein the header further includes a lateral partition plate that is orthogonal to the longitudinal partition plate in the inlet-pipe-side space and the heat-transfer-pipe-side space inside the header and that is configured to divide the internal space of the header into an upper space and a lower space.

7. The heat exchanger according to claim 6, wherein multiple lateral partition plates are arranged in each of the inlet-pipe-side space and the heat-transfer-pipe-side space.

8. The heat exchanger according to claim 6, wherein a working fluid flow path is formed at the lateral partition plate arranged in the inlet-pipe-side space.

9. The heat exchanger according to claim 1, wherein the longitudinal partition plate has two shorter sides and two or more longer sides crossing in an inclined state with respect to the vertical direction and has a longer width than that of each of the shorter sides, and wherein the header further includes a lateral partition plate arranged to extend laterally or to extend diagonally in the inlet-pipe-side space and in the heat-transfer-pipe-side space inside the header and configured to divide the internal space of the header into an upper space and a lower space.

10. The heat exchanger according to claim 9, wherein multiple lateral partition plates are arranged in each of the inlet-pipe-side space and the heat-transfer-pipe-side space.

11. The heat exchanger according to claim 9, wherein the lateral partition plate arranged in the inlet-pipe-side space has a shorter length than the width of each shorter side of the longitudinal partition plate, and is joined to the longitudinal partition plate at a position nearer the longer side in the direction of gravitational force from among the two or more long sides.

12. The heat exchanger according to claim 9, wherein the opening is formed to extend diagonally in an upper-to-lower direction at a position nearer the longer side on an opposite side of the direction of gravitational force from among the two or more long sides.

* * * * *